US007520498B2

(12) United States Patent
Hattori et al.

(10) Patent No.: US 7,520,498 B2
(45) Date of Patent: Apr. 21, 2009

(54) SHEET PUNCH DEVICE, SHEET PROCESSING DEVICE, IMAGE FORMING SYSTEM, PROGRAM, AND RECORDING MEDIUM

(75) Inventors: Hitoshi Hattori, Tokyo (JP); Shinji Asami, Saitama (JP); Takeshi Sasaki, Tokyo (JP); Shohichi Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 94 days.

(21) Appl. No.: 11/616,234

(22) Filed: Dec. 26, 2006

(65) Prior Publication Data

US 2007/0107577 A1 May 17, 2007

Related U.S. Application Data

(62) Division of application No. 10/849,813, filed on May 21, 2004, now Pat. No. 7,172,185.

(30) Foreign Application Priority Data

May 23, 2003 (JP) ..... 2003-146877
Aug. 29, 2003 (JP) ..... 2003-307585

(51) Int. Cl.
*B65H 37/04* (2006.01)

(52) U.S. Cl. ..... 270/58.07

(58) Field of Classification Search ..... 270/58.07; 83/74, 522.15
See application file for complete search history.

(56) References Cited

U.S. PATENT DOCUMENTS 3,528,331 A * 9/1970 Ikelheimer ..... 83/145
4,762,312 A 8/1988 Ushirogata
4,988,085 A 1/1991 Maekawa et al. ..... 270/58.11
5,020,784 A 6/1991 Asami et al.
5,114,130 A 5/1992 Hamanaka et al. ..... 270/58.11
5,199,338 A 4/1993 Schorn et al. ..... 83/13
5,320,336 A 6/1994 Asami
5,508,799 A * 4/1996 Irie ..... 399/404
5,570,877 A 11/1996 Asami et al.
5,597,154 A 1/1997 Yamashita
5,655,765 A 8/1997 Asami et al.
5,706,711 A 1/1998 Ito ..... 83/74

(Continued)

FOREIGN PATENT DOCUMENTS

JP 62-244869 10/1987

(Continued)

*Primary Examiner*—Gene Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A sheet punch device for punching a sheet with a punch edge comprises a motor performing a punching operation and a position detection unit detecting a position of the punch edge. A control unit controls the motor and the position detection unit, wherein the control unit causes the position detection unit to detect a position of the punch edge at a time of or prior to a motor stop in a first driving operation of the motor to perform the punching operation, and, when the detected position deviates from a desired position, the control unit performs restarting of the motor so that the punch edge is brought close to the desired position.

5 Claims, 36 Drawing Sheets

U.S. PATENT DOCUMENTS

| | | | | |
|---|---|---|---|---|
| 5,788,229 | A | 8/1998 | Asami et al. | |
| 5,953,972 | A | 9/1999 | Nakagawa | 83/72 |
| 5,971,388 | A | 10/1999 | Hattori et al. | |
| 6,065,383 | A | 5/2000 | Takaishi et al. | 83/368 |
| 6,091,927 | A | 7/2000 | Hattori et al. | |
| 6,199,853 | B1 | 3/2001 | Andoh et al. | |
| 6,231,045 | B1 | 5/2001 | Yamada et al. | |
| 6,322,070 | B2 | 11/2001 | Yamada et al. | |
| 6,343,785 | B1 | 2/2002 | Yamada et al. | |
| 6,369,540 | B1 | 4/2002 | Lange et al. | 318/471 |
| 6,386,080 | B1 | 5/2002 | Okamoto et al. | 83/73 |
| 6,416,052 | B2 | 7/2002 | Yamada et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,622,908 | B2 | 9/2003 | Fukumoto et al. | 234/98 |
| 6,631,896 | B2 | 10/2003 | Yamada et al. | |
| 6,698,744 | B2 | 3/2004 | Yamada et al. | |
| 6,860,478 | B2 | 3/2005 | Hirai | 270/58.07 |
| 2001/0011492 | A1 | 8/2001 | Fukumoto et al. | 83/549 |
| 2001/0028231 | A1 | 10/2001 | Tanaka | |
| 2004/0261596 | A1 | 12/2004 | Kobayashi | 83/691 |
| 2005/0115377 | A1 | 6/2005 | Kobayashi | 83/684 |

FOREIGN PATENT DOCUMENTS

| | | | |
|---|---|---|---|
| JP | 63-178249 | | 11/1988 |
| JP | 6-144651 | | 5/1994 |
| JP | 08225804 | A * | 9/1996 |
| JP | 11-194432 | | 7/1999 |
| JP | 2000-334694 | | 12/2000 |
| JP | 2001-158140 | | 6/2001 |
| JP | 2001-213570 | | 8/2001 |
| JP | 2001-224189 | | 8/2001 |
| JP | 2002-337095 | | 11/2002 |

* cited by examiner

SHEET PUNCH DEVICE, SHEET PROCESSING DEVICE, IMAGE FORMING SYSTEM, PROGRAM, AND RECORDING MEDIUM

This application is a divisional application of application Ser. No. 10/849,813, filed on May 21, 2004, the entire contents of which are hereby incorporated by reference herein. This application is based on and claims priority to Japanese Application Nos. 2003-146877, filed on May 23, 2003, and 2003-307585, filed on Aug. 29, 2003.

BACKGROUND OF THE INVENTION

1. Field of the Invention

The present invention relates to a sheet punch device for punching the sheet from the copier, the printer, the printing machine, etc., a sheet processing device in which the sheet punch device is provided, an image forming system in which the image forming device, such as the printer, the copier or the facsimile, and the sheet processing device are integrally or separately provided, and a computer program product embodied therein to cause a computer to execute the control function of the sheet punch device in the image forming system.

2. Description of the Related Art

In recent years, small-size, low-cost devices are demanded. Also, in order to provide a small-size, low-cost sheet punch device (also called the punch unit), the DC brush motor has been used as a punching drive motor for the sheet punch device.

On the other hand, the 2-hole/3-hole changeable punch function and the improvement in the punching speed (or the shortening of the punch time) are also demanded. With the provision of such additional functions, the precision of the motor stop in the sheet punch device tends to deteriorate. Hence, there is a need for the improvement in the motor stop precision.

The punch unit or the sheet punch device which uses the rotation drive of a punch motor for the punching power is known. For example, Japanese Laid-Open Patent Application No. 2002-337095 discloses such a sheet punch device. The punch motors used as the power source in the sheet punch device include the punch motor, the brush-less motor, the DC brush motor, etc.

The sheet punch device, disclosed in Japanese Laid-Open Patent Application No. 2002-337095, has the 2-hole/3-hole changeable punch function, and, with the provision of this additional function, the motor drive range with which the punch edge is in the evacuation position (where the punch edge does not project from the lower frame) becomes narrow.

For this reason, if the motor stop precision deteriorates, the punch edge will project from the lower frame at the time of the motor stop, which causes a trouble in the sheet conveyance in the image forming system.

On the other hand, the motors used as the power source in the sheet punch device of this kind include the stepping motor, the brushless motor, the DC brush motor, etc. Among these motors, the stepping motor the amount of rotation of which can be controlled is desirable in order to increase the motor stop precision. However, in order to secure the torque of the motor required for sheet punching, it is necessary to use a large-size stepping motor with which the amount of rotation can be controlled, and the cost of the large-size stepping motor will be raised.

Furthermore, in recent years, the improvement in the punching speed of the sheet punch device is demanded with the improvement in the processing speed of the post-processing device. Also, for this reason, the size and cost of the motor used in the sheet punch device are likely to increase.

SUMMARY OF THE INVENTION

An object of the present invention is to provide an improved sheet punch device in which the above-described problems are eliminated.

Another object of the present invention is to provide a sheet punch device which is inexpensive and small in size and realizes high-speed sheet processing with good motor stop precision.

Another object of the present invention is to provide a sheet processing device incorporating the sheet punch device which is inexpensive and small in size and realizes high-speed sheet processing with good motor stop precision.

Another object of the present invention is to provide an image forming system in which the sheet processing device is provided which incorporates the sheet punch device which is inexpensive and small in size and realizes high-speed sheet processing with good motor stop precision.

Another object of the present invention is to provide a computer program product embodied therein for causing the computer to execute the control function of the sheet punch device, in the image forming system, which is inexpensive and small in size and realizes high-speed sheet processing with good motor stop precision.

The above-mentioned objects of the present invention are achieved by a sheet punch device for punching a sheet with a punch edge, the sheet punch device comprising: a motor performing a punching operation; a position detection unit detecting a position of the punch edge; and a control unit controlling the motor and the position detection unit, wherein the control unit causes the position detection unit to detect a position of the punch edge at a time of or prior to a motor stop in a first driving operation of the motor to perform the punching operation, and, when the detected position deviates from a desired position, the control unit performs restarting of the motor so that the punch edge is brought close to the desired position.

The above-mentioned objects of the present invention are achieved by a sheet punch device for punching a sheet with a punch edge, the sheet punch device comprising: a motor performing a punching operation; a position detection unit detecting a position of the punch edge; and a control unit controlling the motor and the position detection unit, wherein the control unit causes the position detection unit to detect a position of the punch edge at a time of or prior to a motor stop in a first driving operation of the motor to perform the punching operation, and, when the detected position deviates from a desired position, the control unit changes a motor-drive amount to restart the motor, in accordance with an amount of the deviation of the detected position from the desired position.

The above-mentioned objects of the present invention are achieved by a sheet punch device for punching a sheet delivered from an external device, the sheet punch device comprising: a motor performing a punching operation on the sheet; a motor-drive amount detection unit detecting an amount of driving of the motor; a timer unit detecting that a predetermined standard time has elapsed during the driving of the motor; and a control unit causing the motor drive amount detection unit to detect a motor-drive amount of the motor during the punching operation at a time the standard time has elapsed, and the control unit changing a starting position of a motor stop operation in accordance with the detected motor-drive amount.

The above-mentioned objects of the present invention are achieved by a sheet processing device in which a sheet punch device for punching a sheet with a punch edge is provided, the sheet processing device comprising a sheet processing unit receiving the sheet, performing post-processing of the sheet including a punching operation on the sheet, and ejecting the punched sheet, the sheet punch device comprising: a motor performing the punching operation; a position detection unit detecting a position of the punch edge; and a control unit controlling the motor and the position detection unit, wherein the control unit causes the position detection unit to detect a position of the punch edge at a time of or prior to a motor stop in a first driving operation of the motor to perform the punching operation, and, when the detected position deviates from a desired position, the control unit performs restarting of the motor so that the punch edge is brought close to the desired position.

The above-mentioned objects of the present invention are achieved by a sheet processing device in which a sheet punch device for punching a sheet is provided, the sheet processing device receiving the sheet and performing post-processing of the sheet, the sheet punch device comprising: a motor performing a punching operation on the sheet; a motor-drive amount detection unit detecting an amount of driving of the motor; a home-position detection unit detecting a home position of a punch edge; and a control unit causing the motor-drive amount detection unit and the home-position detection unit to detect a motor stop position when a punching operation including an initial operation is performed by the motor, and the control unit changing a motor stop operation when a subsequent punching operation is performed by the motor at a time following the initial operation, in accordance with the detected motor stop position during the initial operation.

The above-mentioned objects of the present invention are achieved by an image forming system in which a sheet processing device and an image forming device are provided integrally or separately, the sheet processing device comprising: a sheet punch device punching a sheet with a punch edge; and a sheet processing unit receiving the sheet, performing post-processing of the sheet including a punching operation, and ejecting the punched sheet, the sheet punch device comprising: a motor performing the punching operation; a position detection unit detecting a position of the punch edge; and a control unit controlling the motor and the position detection unit, wherein the control unit causes the position detection unit to detect a position of the punch edge at a time of or prior to a motor stop in a first driving operation of the motor to perform the punching operation, and, when the detected position deviates from a desired position, the control unit performs restarting of the motor so that the punch edge is brought close to the desired position.

The above-mentioned objects of the present invention are achieved by an image forming system in which a sheet processing device and an image forming device are provided, the sheet processing device including a sheet punch device for punching a sheet, the sheet processing device receiving the sheet and performing post-processing of the sheet, the sheet punch device comprising: a motor performing a punching operation on the sheet; a motor-drive amount detection unit detecting an amount of driving of the motor; a home-position detection unit detecting a home position of a punch edge; and a control unit causing the motor-drive amount detection unit and the home-position detection unit to detect a motor stop position when a punching operation including an initial operation is performed by the motor, and the control unit changing a motor stop operation when a subsequent punching operation is performed by the motor at a time following the initial operation, in accordance with the detected motor stop position during the initial operation.

The above-mentioned objects of the present invention are achieved by a computer program product embodied therein for causing a computer to execute a method of controlling a sheet punch device for punching a sheet with a punch edge, the sheet punch device including a motor performing a punching operation, and a position detection unit detecting a position of the punch edge, the method comprising steps of: causing the position detection unit to detect a position of the punch edge at a time of or prior to a motor stop in a first driving operation of the motor to perform the punching operation; and performing, when the detected position deviates from a desired position, restarting of the motor so that the punch edge is brought close to the desired position.

The above-mentioned objects of the present invention are achieved by a computer program product embodied therein for causing a computer to execute a method of controlling a sheet punch device for punching a sheet with a punch edge, the sheet punch device including a motor performing a punching operation, and a position detection unit detecting a position of the punch edge, the method comprising steps of: causing the position detection unit to detect a position of the punch edge at a time of or prior to a motor stop in a first driving operation of the motor to perform the punching operation; and changing, when the detected position deviates from a desired position, a motor-drive amount to restart the motor, in accordance with an amount of the deviation of the detected position from the desired position.

According to the present invention, it is possible to provide a small-size, low-cost sheet punch device which enables the high-speed sheet processing with good motor stop precision. It is also possible to provide the sheet processing device with this sheet punch device, and it is possible to provide the image forming system with this sheet processing device.

Moreover, according to the present invention, it is possible to provide the computer program product embodied therein for causing the computer to execute the control function of the sheet punch device in the image forming system.

Especially, when the DC brush motor is used as the drive motor for punching operation, it is possible for the sheet punch device of the present invention to provide good motor stop precision.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will now be given of the preferred embodiments of the invention with reference to the accompanying drawings.

In the following preferred embodiments of the invention, the DC brush motor constitutes the motor in the claims, the pulse-count sensor, the home-position sensor, the encoder and the CPU constitute the position detection unit in the claims, the CPU constitutes the control unit in the claims, the encoder, the pulse-count sensor and the CPU constitute the motor-drive amount detection unit in the claims, and the timer constitutes the time measurement unit in the claims.

Figure 1:
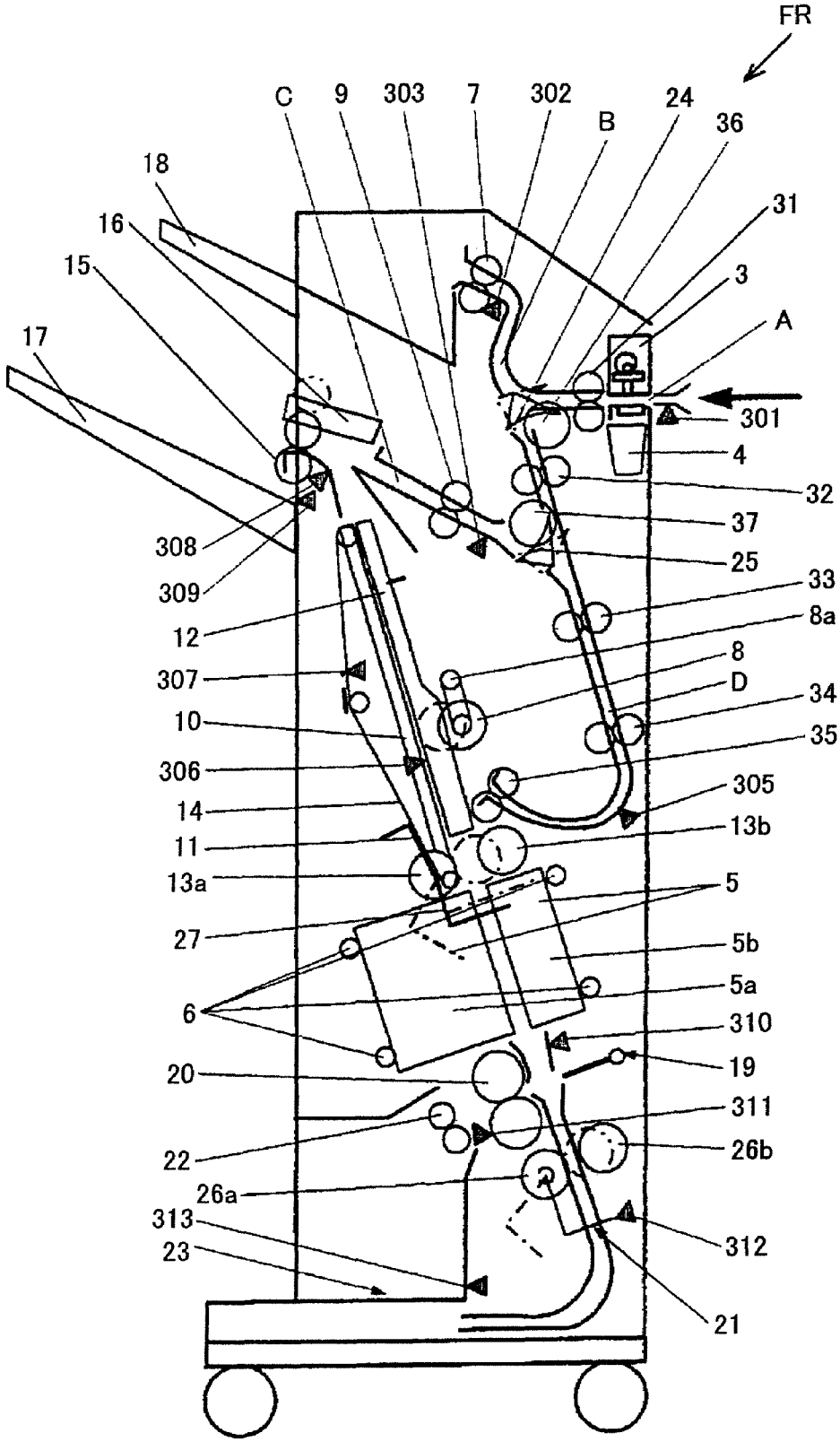
FIG. 1 is a diagram showing the composition of a sheet processing device to which an embodiment of the sheet punch device of the invention is applied.
Figure 2:
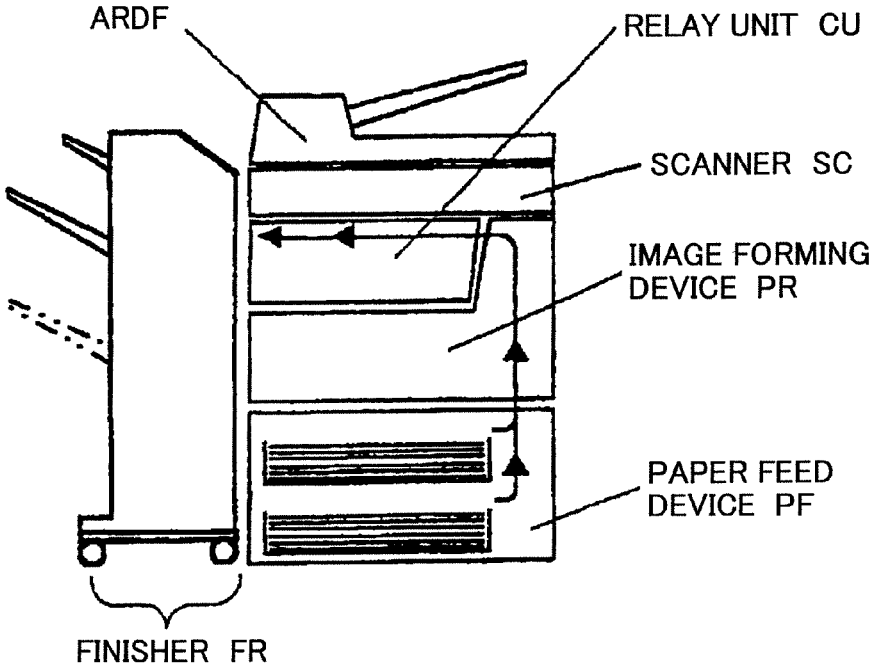
FIG. 2 is a diagram showing the composition of an image forming system (the copier form) in which the sheet processing device of FIG. 1 is provided.
Figure 3:
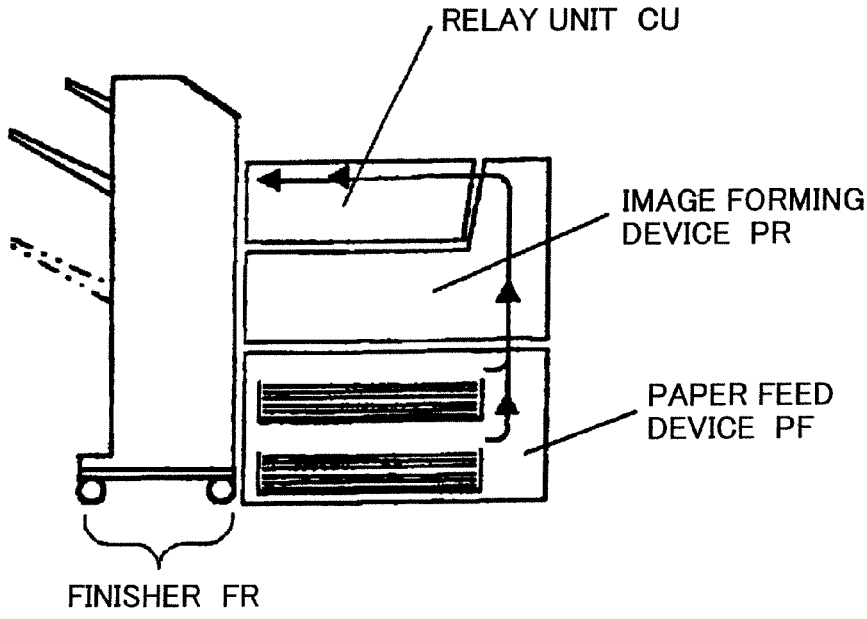
FIG. 3 is a diagram showing the composition of an image forming system (the printer form) in which the sheet processing device of FIG. 1 is provided.

FIG. 1 shows the composition of a sheet processing device to which an embodiment of the sheet punch device of the invention is applied. FIG. 2 shows the composition of an image forming system (the copier form) in which the sheet processing device of FIG. 1 is provided. FIG. 3 shows the composition of an image forming system (the printer form) in which the sheet processing device of FIG. 1 is provided.

In FIG. 2, the outline composition of the image forming system in the copier form is shown. This image forming system includes the image forming device PR, the paper feed device PF for supplying the sheet to the image forming device, the scanner SC for reading the image, and the automatic recirculating document feed device ARDF. The sheet on which the image is formed by the image forming device PR is delivered through the relay unit CU to the entrance guide board of the finisher FR.

In FIG. 3, the outline composition of the image forming system in the printer form is shown. This image forming system does not includes the scanner SC and the automatic recirculating document feed device ARDF but the other composition of the printer-form image forming system is the same as that of the copier-form image forming system of FIG. 1.

The sheet processing device of the present embodiment is shown as the finisher FR, and this finisher FR is attached to the side portion of the image forming device PR as shown in FIG. 2 and FIG. 3. The sheet which is discharged from the image forming device PR is delivered to the sheet processing device FR wherein various kinds of post-processing are given to the sheet by the functions of the sheet processing device FR.

In addition, the image forming device PR may be any known image forming device having the known image-forming functions, such as the electrophotographic image-forming device or the image-forming device having the ink-jet print head. Hence, a description of the image forming device PR will be omitted.

In the sheet processing device FR, which is the sheet processing device of the present embodiment, the sheet is received from the image forming device PR as shown in FIG. 1. The sheet is delivered to the entrance conveyance path A where the punch unit 3 is provided as a sheet punch device which performs post-processing of the sheet including a punching operation. The sheet sent from the punch unit 3 is distributed to any of the upper conveyance path B, the middle conveyance path C and the lower conveyance path D, by means of the branch lug 24, the turn guide 36, the branch lug 25, and the turn guide 37.

The sheet sent to the upper conveyance path B is delivered from the ejection roller 7 to the proof tray 18. The sheet sent to the middle conveyance path C is delivered to the shift roller 9. The sheet sent to the lower conveyance path D is delivered to the staple tray 10 which performs adjustment, staple binding, etc of the sheet.

The sheet which is delivered to the staple tray 10 by the conveyance rollers 33, 34 and 35 is adjusted in the direction perpendicular to the sheet conveyance direction by the jogger fence 12 on the staple tray 10. At the same time, the sheet is adjusted on the staple tray 10 in the sheet conveyance direction by the rear end fence 27 and the roller 8.

Then, in the case of end-surface binding, the staple processing in the predetermined position of the sheet is performed by the staple tray 10. The sheet from the staple unit 10 is conveyed upwards by the discharge lug 11, and it is ejected to the ejection tray 17 by the discharge roller 15. The reference numeral 16 in FIG. 1 indicates the guide plate for the discharge roller 15.

Figure 5:
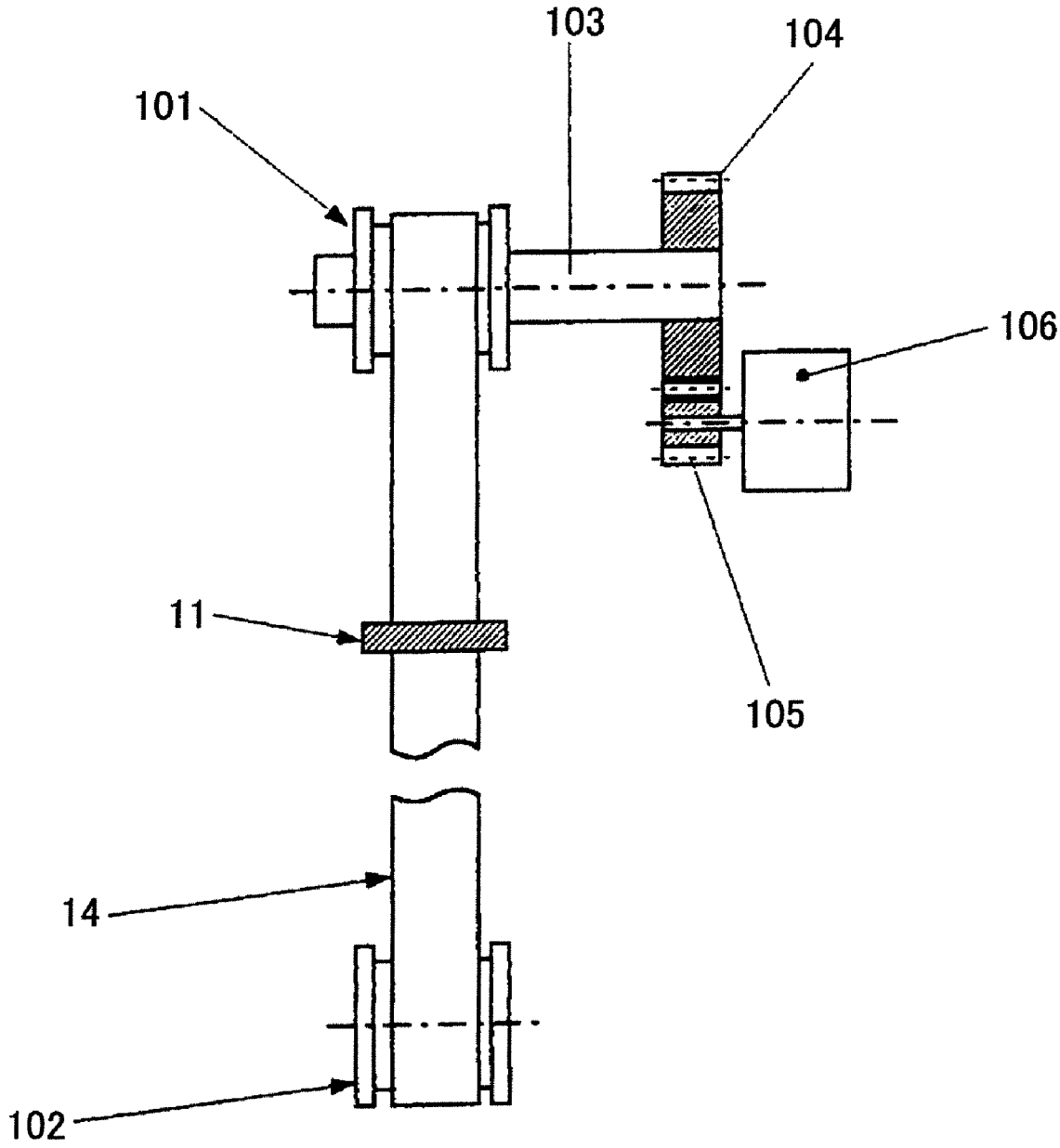
FIG. 5 is a diagram showing the composition of the drive section of the discharge belt and the discharge lug.

FIG. 5 shows the outline composition of the drive section of the discharge belt 14 and the discharge lug 11. The driving shaft 103 is connected with the timing pulley 101 which is the drive side of the timing pulleys 101,102 around which the discharge belt 14 is wound. The driving force is obtained from the stepping motor 106 through the gears 104,105 provided in the driving shaft concerned.

On the other hand, in the case of middle binding, after the sheet bunch is arranged, the sheet bunch is conveyed by the bunch conveyance roller pair 13*a* and 13*b* to the lower portion, and the middle binding processing is performed on the sheet bunch in the middle binding position. And after the middle binding processing is completed, with the bunch conveyance rollers 26*a* and 26*b*, the sheet bunch is conveyed to the middle folding position, and with the folding plate 19 and the folding roller pair 20, the middle folding processing is performed, and the folded sheet bunch is ejected and loaded into the middle folding ejection tray 23 by the middle folding ejection roller 22.

The entrance sensor 301 which detects the sheet received from the image forming device PR is arranged in the common entrance conveyance path A which is located in the upstream of each of the upper conveyance path B, the middle conveyance path C and the lower conveyance path D. And at its downstream portion the conveyance roller 31 and the punch unit 3 are arranged, and at their downstream portion the branch lug 24 and the turn guide 36 are arranged one by one.

The branch lug 24 is held with the spring (not illustrated) in the state indicated by the solid line in FIG. 1. By turning ON the solenoid (not illustrated), the branch lug 24 is rotated counterclockwise, and the sheet is distributed in the direction of lower conveyance path D. If the solenoid is turned OFF, the sheet is distributed to the upper conveyance path B.

The branch lug 25 is held with the spring (not illustrated) in the state indicated by the solid line in FIG. 1. By turning ON the solenoid (not illustrated), the branch lug 25 is rotated clockwise, and the sheet is distributed to the middle conveyance path C. If the solenoid is turned OFF, the sheet is sent to the lower conveyance path D, and is conveyed with the conveyance rollers 33 and 34. The turn guides 36 and 37 have the function to help the distribution of the sheet by the branch lugs 24 and 25, respectively. With the branch lugs 24 and 25, the conveyance direction of the sheet is bent, and the turn guides 36 and 37 are moved together, and have the function to reduce conveyance resistance of the sheet at the small diameter portion.

In the middle conveyance path C, the shift roller 9 is provided which can move the sheet by a fixed quantity in the direction perpendicular to the sheet conveyance direction. The shift roller 9 performs the shift function by moving the sheet in the direction perpendicular to the sheet conveyance direction by the drive unit (not illustrated). The sheet passing the conveyance roller 32 and the turn roller 37 and sent to the middle conveyance path C is moved by the fixed quantity in the direction perpendicular to the sheet conveyance direction during conveyance by the shift roller 9, and with the fixed quantity deviation the sheet is ejected and loaded onto the ejection tray 17 by the discharge roller 15 without changing the state of the sheet.

In addition, the timing is determined based on the sheet detection information of the roller shift sensor 303 and the size information of the sheet.

The staple tray ejection sensor 305 is provided in the lower conveyance path D, and the output signal of this sensor serves as the trigger of adjusting operation at the time of discharging the sheet to the staple tray 10 when the presence of the sheet in the conveyance path is detected. With the conveyance rollers 33, 34, and 35, the sheet sent to the conveyance path D is conveyed one by one, and the adjusting operation is performed on the sheet after the sheet is loaded onto the staple tray 10.

Figure 6:
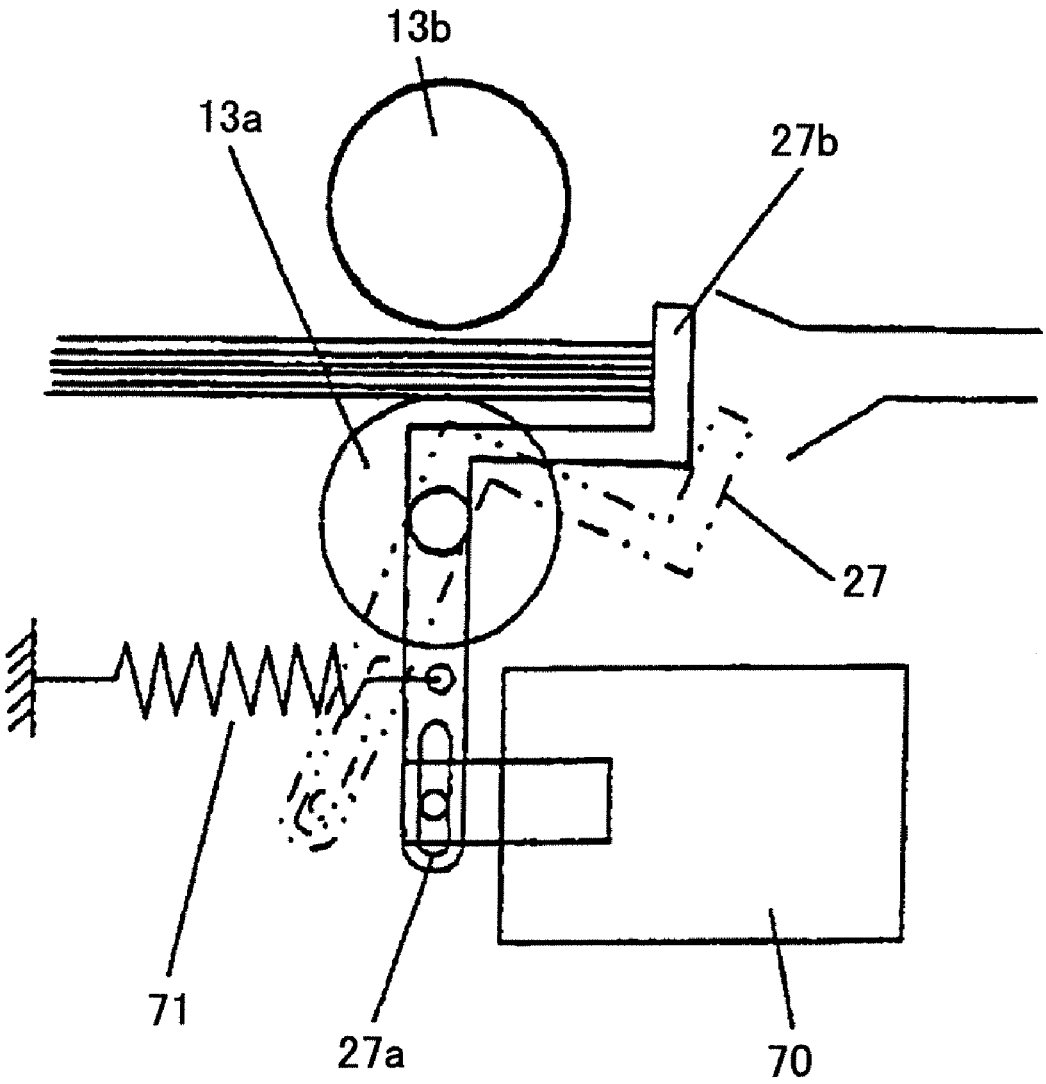
FIG. 6 is a diagram showing the composition of the drive mechanism of the rear end fence.

As for the rear end of the sheet delivered to the staple tray 10, the adjustment is performed on the basis of the rear end fence 27 as the first sheet bunch regulation unit. The rear end fence 27 is configured, as shown in FIG. 6, so that it is rotatable around the central axis of the bunch conveyance roller 13*a*. The end 27*a* of the rear end fence 27 on the side of the solenoid is driven by the solenoid 70, so that the tip section 27*b* of the fence 27 is evacuated from the conveyance path. Thereby, it is possible to avoid the barring of the conveyance of the sheet bunch.

In addition, the reference numeral 71 indicates a spring which carries out elastic energization of the tip section 27*b* of the rear end fence 27 at the side which always evacuates from the conveyance path.

Figure 4:
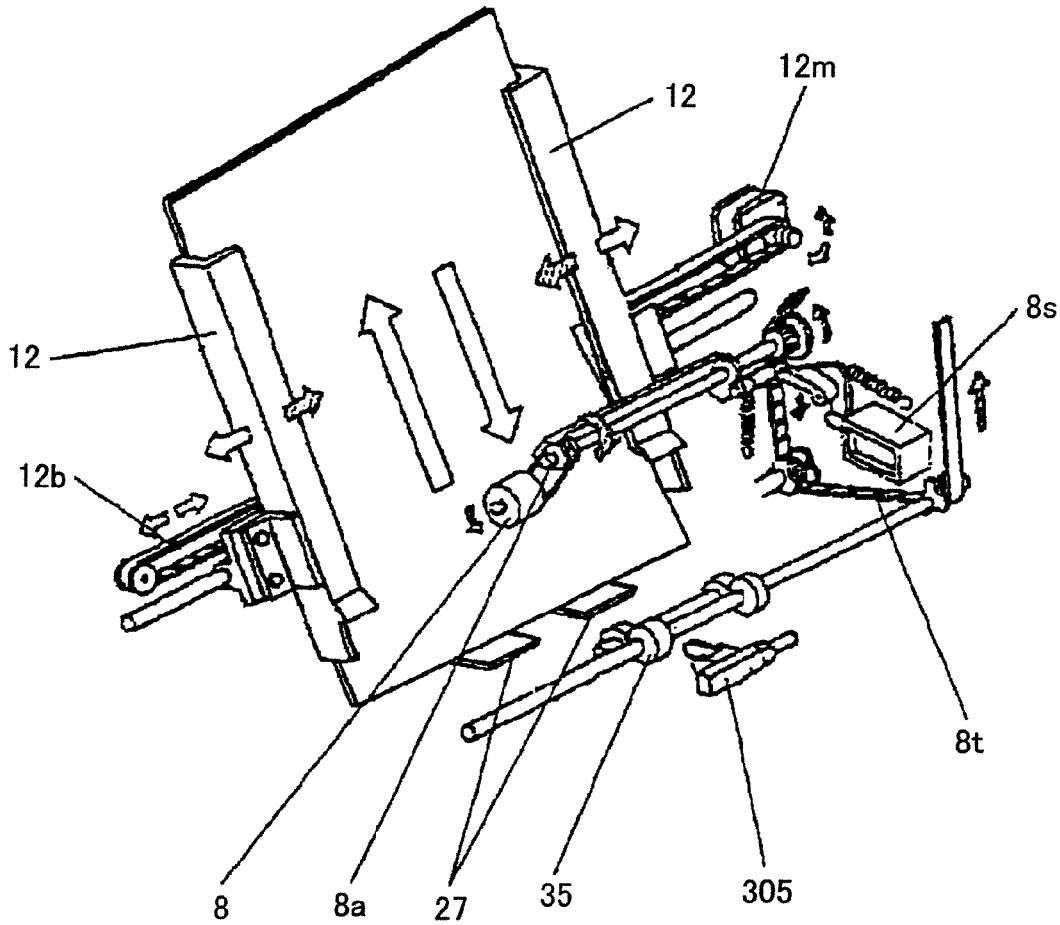
FIG. 4 is a diagram showing the composition of the mechanism arranged around the staple tray.

The sheet loaded into the staple tray 10 is dropped to the bottom by the roller 8, and the lower edge of the sheet is arranged. FIG. 4 shows the mechanism of the circumference of the staple tray 10. The roller 8 is swing around the supporting-point 8*a*, as shown in FIG. 4, with the pendulum movement by the solenoid 8*s*. The roller 8 acts on the sheet sent to the staple tray 10 intermittently, and brings the sheet rear end in contact with the rear end fence 27.

In addition, the roller 8 is rotated in the counterclockwise direction by the timing belt 8*t* to move the sheet to the rear end fence 27. The adjustment of the sheet in the conveyance direction of the sheet loaded to the staple tray 10 and in the direction perpendicular to the sheet conveyance direction is carried out by the jogger fence 12.

The jogger fence 12 is driven through the timing belt 12*b* by the jogger motor 12*m* as shown in FIG. 4 so that the forward or reverse rotation is possible. The jogger fence 12 carries out bi-directional movement of the sheet in the sheet conveyance direction and the perpendicular direction thereof.

By performing operation to press down the end surface of the sheet by the bi-directional movement, the adjustment of the sheet in the sheet conveyance direction and the direction perpendicular to the sheet conveyance direction is performed. This operation is performed at any time during the sheet loading and after the loading of the last sheet. The sensor 306, which is provided in the staple tray 10, is called the sheet detection sensor which detects the presence of the sheet on the staple tray 10.

The roller 8, the rear end fence 27, and the jogger fence 12 constitute the adjustment unit which adjusts the sheet bunch in the direction parallel to the sheet conveyance direction and in the intersecting direction perpendicular to the sheet conveyance direction.

According to the mechanism of FIG. 7, pressurization and release operation are possible for the bunch conveyance rollers 13*a* and 13*b* and the bunch conveyance rollers 26*a* and 26*b*. The sheet bunch in the released state is passed between the rollers, and the sheet bunch is pressurized and conveyed. The bunch conveyance rollers 13*a* and 13*b* and the bunch conveyance rollers 26*a* and 26*b* are freely subjected to the pressure applying/releasing movement by the pressure releasing motor 63. The rotation driving of the conveyance rollers 13*a* and 13*b* and the rollers 26*a* and 26*b* is carried out by the stepping motor 50, and the amount of conveyance of the sheet bunch is controlled by controlling the rotational amount of the stepping motor 50.

The pressure applying/releasing movement of the bunch conveyance rollers 13*a* and 13*b* and the bunch conveyance rollers 26*a* and 26*b* can be carried out independently of each other.

Since the pressure releasing mechanism of each bunch conveyance roller is the same, a description will now be given of the bunch conveyance rollers 13*a* and 13*b* only.

As shown in FIG. 7, the drive system is connected with the bunch conveyance rollers 13*a* and 13*b* so that they have the opposite rotation direction and the same rotation speed.

The driving force is transmitted by driving the timing belt 52 through the driving shaft 51 of the stepping motor 50 to the timing pulley 53 and the gear pulley 54 which are coaxially connected to the bunch conveyance roller 13*a* by using the stepping motor 50 as the driving source.

Furthermore, from the gear pulley 54, the driving force is transmitted to the timing pulley 58 connected coaxially to the bunch conveyance roller 13*b* through the arm 56 with the timing belt 57 through the idler pulley 55, and the bunch conveyance roller 13*b* is rotated.

The rotation of the arm 56 around the gear pulley 55 is possible, and it acts in the direction which carries out the pressure applying to the sheet with the tension spring 64 provided in the bunch conveyance roller 13*b* axis.

Moreover, it is fitted loosely to the convex section 60*p* which the link 59 is connected with the bunch conveyance roller 13*b* axis, and the elongated hole 59*a* is provided in the other side of the link, and is provided on the circumference of the gear 60 rotatably.

Moreover, the sensor 61 for detecting the open state of the bunch conveyance rollers 13*a* and 13*b* by the filler 60*a* is provided at the end of the gear 60, and the counterclockwise rotation or the clockwise rotation of the stepping motor 63 is performed and the gear 60 is driven by the drive gear 62, so that the pressure applying or the pressure releasing operation is performed.

Figure 7A:
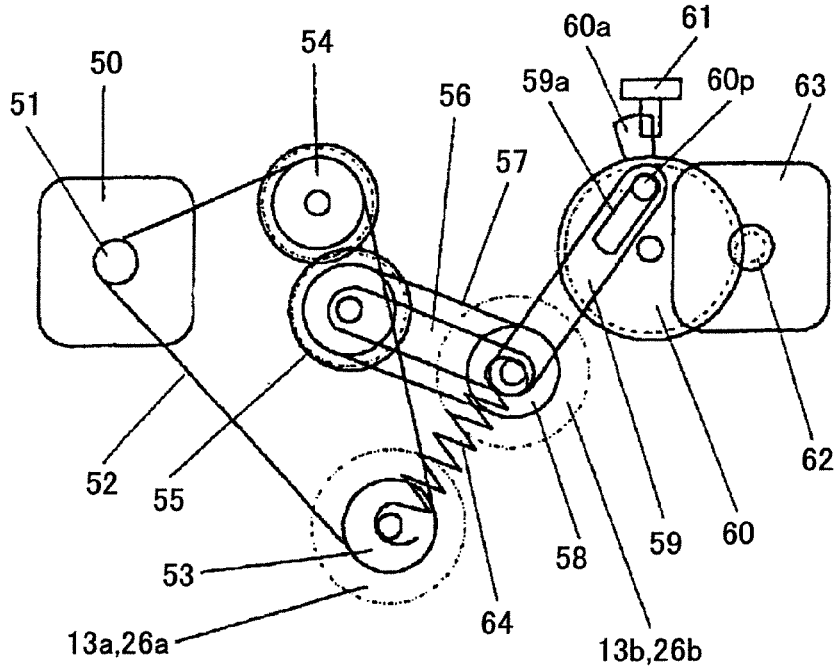
FIG. 7A and FIG. 7B are diagrams for explaining the mechanism and operation of the bunch conveyance roller.
Figure 7B:
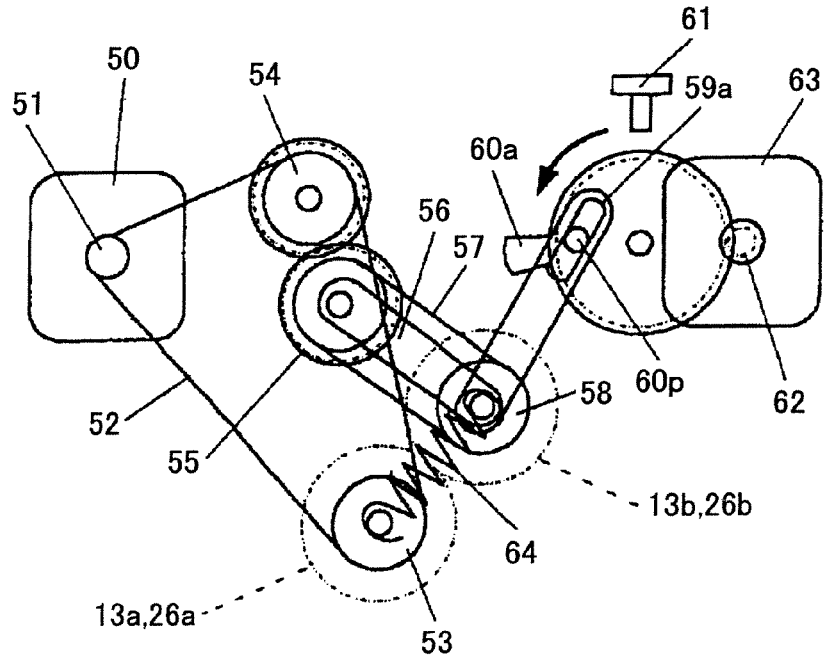

FIG. 7A shows the state of the pressure releasing, and FIG. 7B shows the state of the pressure applying.

The staple unit 5 comprises the sticker section 5*a* which sticks the needle, and the clincher section 5*b* which clinches the tip of the needle driven into the sheet bunch. In the staple unit 5 in this embodiment, the sticker section 5*a* and the clincher section 5*b* are provided separately, and they are movable both in the sheet bunch conveyance direction and in the direction perpendicular to the sheet bunch conveyance direction by the stapler move guide 6. The sticker section 5*a* and the clincher section 5*b* are provided with the relative positioning mechanism and the moving mechanism which are not illustrated.

The staple positioning in the conveyance direction of the sheet bunch is performed by conveying the sheet bunch with the bunch conveyance rollers 13*a* and 13*b*. With these components, the staple fixing operation can be performed at various positions of the sheet bunch.

The middle folding mechanism section is provided in the sheet conveyance direction downstream side of the staple unit 5 (it is the downstream side in the case of folding the sheet, or the lower position of the staple unit 5). The middle folding mechanism includes the roller pair 20, the folding plate 19, the stopper 21, etc. The sheet bunch, with which the staple fixing is performed in the center of the conveyance direction of the sheet by the upstream-side staple unit 5, is conveyed by the bunch conveyance rollers 13*a* and 13*b* until the sheet bunch contacts the stopper 21. Once the nip pressure of the bunch conveyance roller 13*b* is canceled and the reference position at which the middle folding of the sheet bunch is performed is determined.

Then, the sheet bunch is held with the nip pressure of the bunch conveyance rollers 26*a* and 26*b* applied, and the stopper 21 is separated from the sheet bunch rear end, and in accordance with the paper-size signal sent from the main part of the image forming device, the required distance is conveyed and the position of the middle folding is taken out. The sheet bunch which is conveyed and stopped to the position (usually the center of the sheet bunch conveyance direction) of the folding plate 19 and the roller pair 20 is pushed into the nip pressure so that the roller pair 20 folds the sheet bunch the inside by pressurizing and rotating.

In that case, if the paper size is large, the sheet bunch will be sent to the sheet conveyance direction downstream side rather than the stopper 21.

Then, in this embodiment, from the stopper 21 arrangement position, the conveyance path by the side of the downstream portion is evacuated, and the end of the sheet bunch is drawn horizontally.

Thus, even if it is the thing of the big paper size by constituting, conveyance of the sheet is attained and it becomes possible to make size of the height direction of sheet processing device FR compact.

Figure 8:
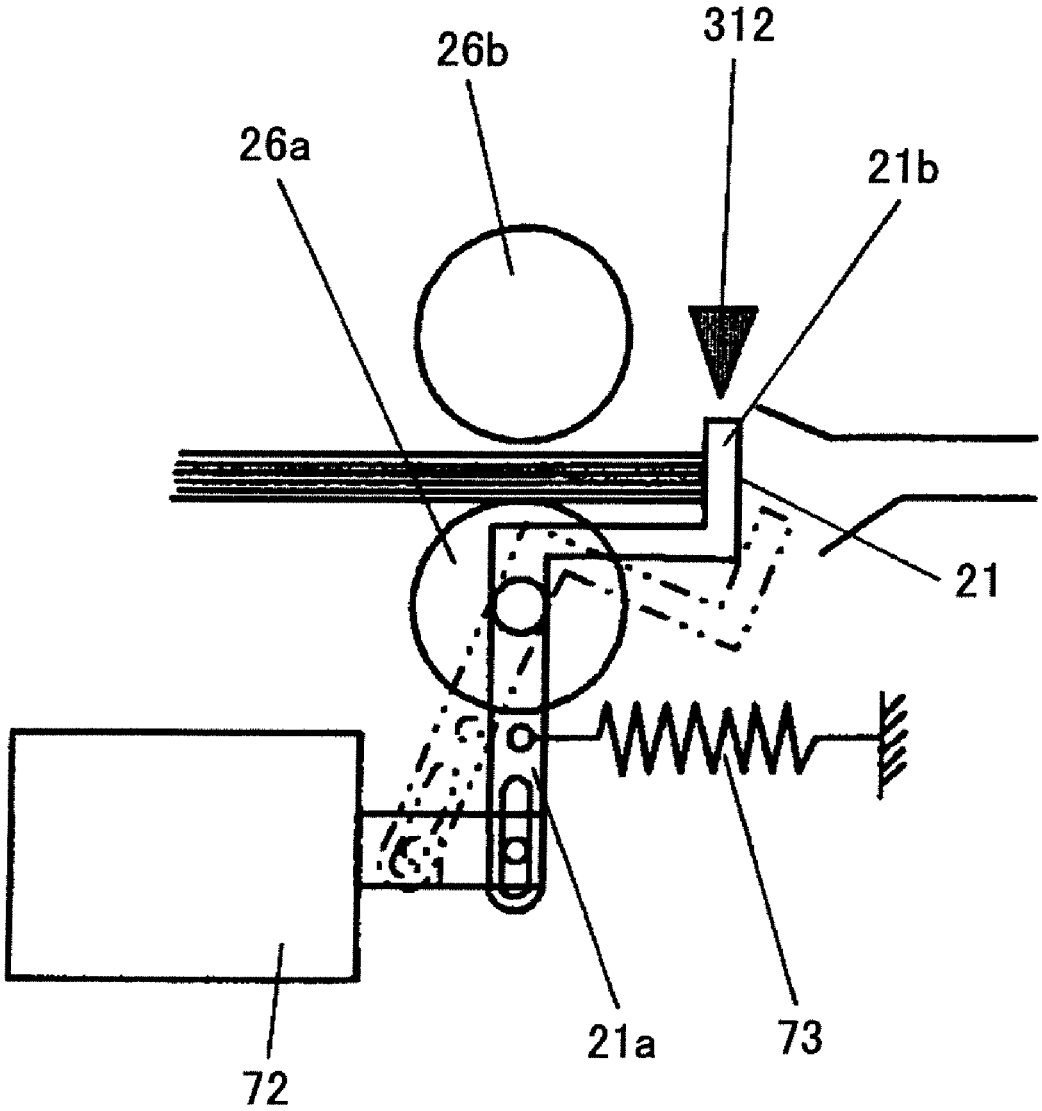
FIG. 8 is a diagram showing the composition of the drive mechanism of the stopper.

In addition, as shown in FIG. 8, the stopper 21 as 2nd sheet bunch regulation unit has composition which can be rotated focusing on the medial axis of bunch conveyance roller 26*a*, and end 21*a* by the side of the solenoid drives it by the solenoid 72, and it has the composition that tip section 21*b* shunts the conveyance path. Reference numeral 73 in FIG. 8 indicates a spring which carries out elastic energization of the stopper 21 in order to make the conveyance path always project tip section 21*b* of the stopper 21.

By the middle folding ejection roller 22, the folded sheet bunch is delivered to the middle folding ejection tray 23 and loaded therein. The sensor 310,311 of the middle folding section detects the existence of the sheet.

Moreover, by detecting the existence of the sheet bunch on the middle folding ejection tray 23, and counting the number of the sheet bunches to which the paper is delivered from the state without the sheet bunch, the sensor 313 of the middle folding ejection tray 23 is used in order to perform full detection of the middle folding ejection tray 23 in false.

Moreover, the middle folding and the stopper position detection sensor 312 detect the end position of the sheet bunch when the operation of the stopper 21 and the stopper are canceled.

FIG. 9A through FIG. 9D are diagrams for explaining the operation of the end-surface binding.

Figure 9A:
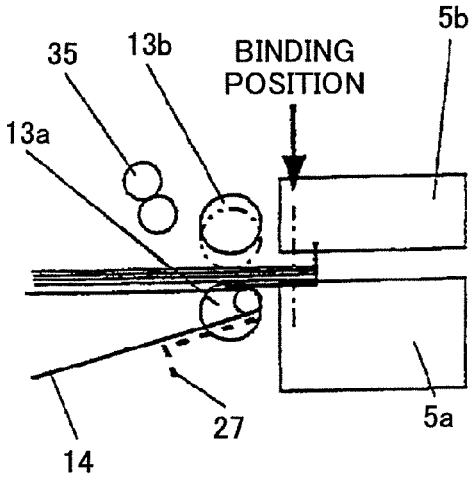
FIG. 9A, FIG. 9B, FIG. 9C and FIG. 9D are diagrams for explaining the operation of the end surface binding.

FIG. 9A shows the state in which the rear end of the sheet bunch is arranged so as to be matched in both the sheet conveyance direction and the direction perpendicular to the sheet conveyance direction. The required number of sheets are stacked in this state.

Figure 9B:
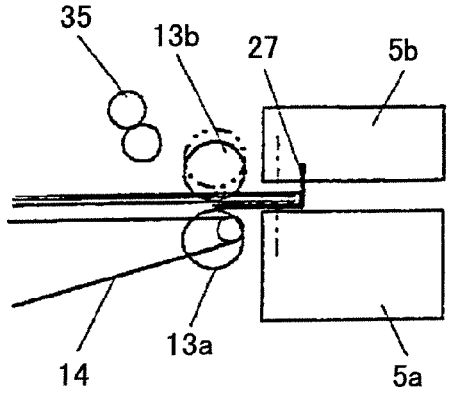
Figure 9C:
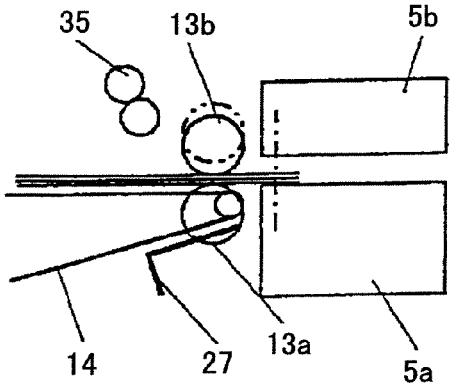
Figure 9D:
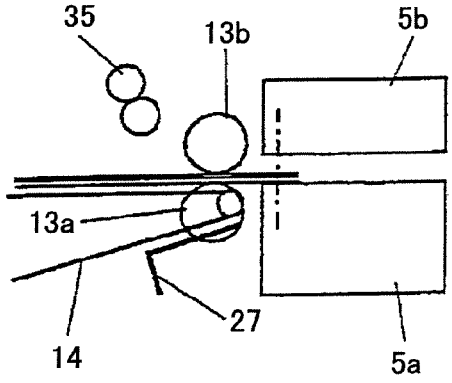

As shown in FIG. 9B, the sheet bunch is interposed between the bunch conveyance rollers 13*a* and 13*b*. As shown in FIG. 9C, the rear end fence 27 is retracted and the staple unit 5 is moved to the staple position. As shown in FIG. 9D, the end-surface binding operation is performed in this state.

FIG. 10A through FIG. 10D are diagrams for explaining the middle binding operation.

Figure 10A:
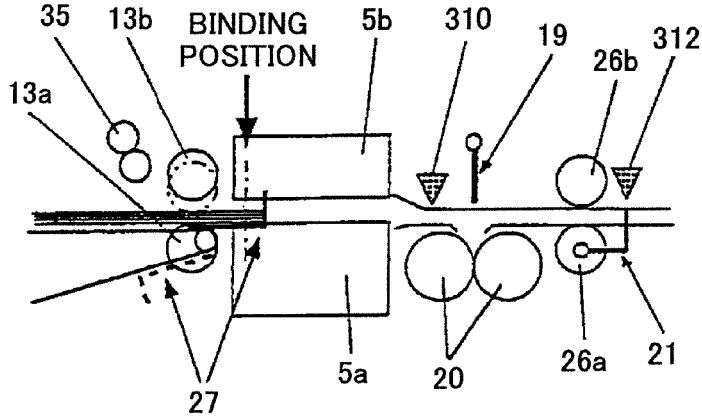
FIG. 10A, FIG. 10B, FIG. 10C and FIG. 10D are diagrams for explaining the operation of the middle binding.

FIG. 10A shows the state in which the rear end of the sheet bunch is arranged so as to be matched in both the sheet conveyance direction and the direction perpendicular to the sheet conveyance direction. The required number of sheets are stacked in this state.

Figure 10B:
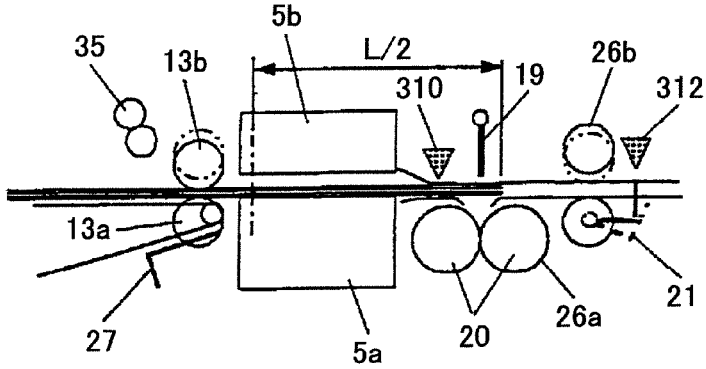

As shown in FIG. 10B, the sheet bunch is interposed between the bunch conveyance rollers 13*a* and 13*b*, and the rear end fence 27 is retracted and the sheet bunch is moved toward the folding plate 19 (in the lower direction). And the sheet bunch is stopped at the binding position in the middle of the conveyance direction length of the sheet bunch where the sheet bunch is subjected to the middle binding operation by the staple unit 5.

Figure 10C:
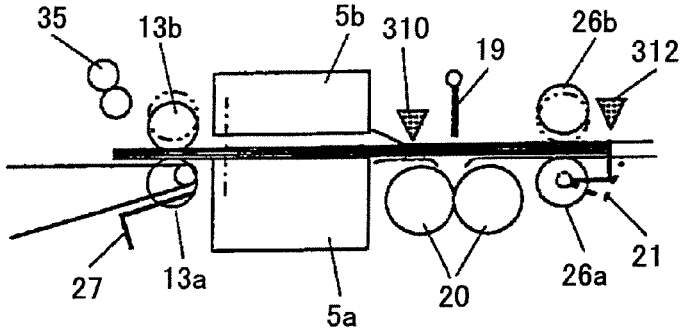

As shown in FIG. 10C, the sheet bunch subjected to the middle binding operation is conveyed further to the lower portion and stopped in contact with the stopper 21. After positioning is performed, the sheet bunch is further conveyed until the binding position reaches the folding position of the folding plate 19.

Figure 10D:
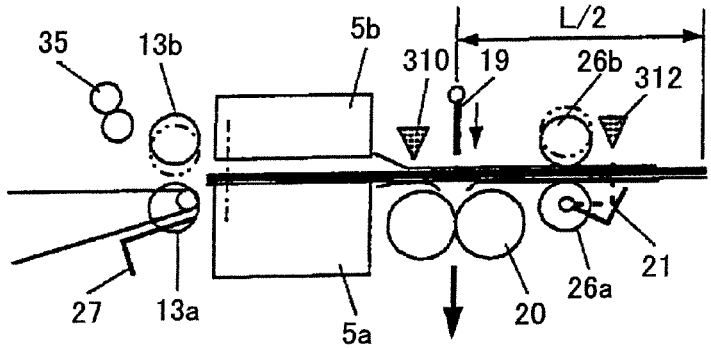

As shown in FIG. 10D, the sheet bunch is stopped in the above position, and the folding plate 10 is made to project. The sheet bunch is pushed into the nip of the rollers 20. Thus, it possible to fold the sheet bunch at the binding position. In addition, if the tip of the folding plate 19 is made to project so as to be in contact with the sheet bunch, the staple needle contacts the folding plate 19 when the folding position is reached, and the precision of the folding position can be secured.

Figure 11:
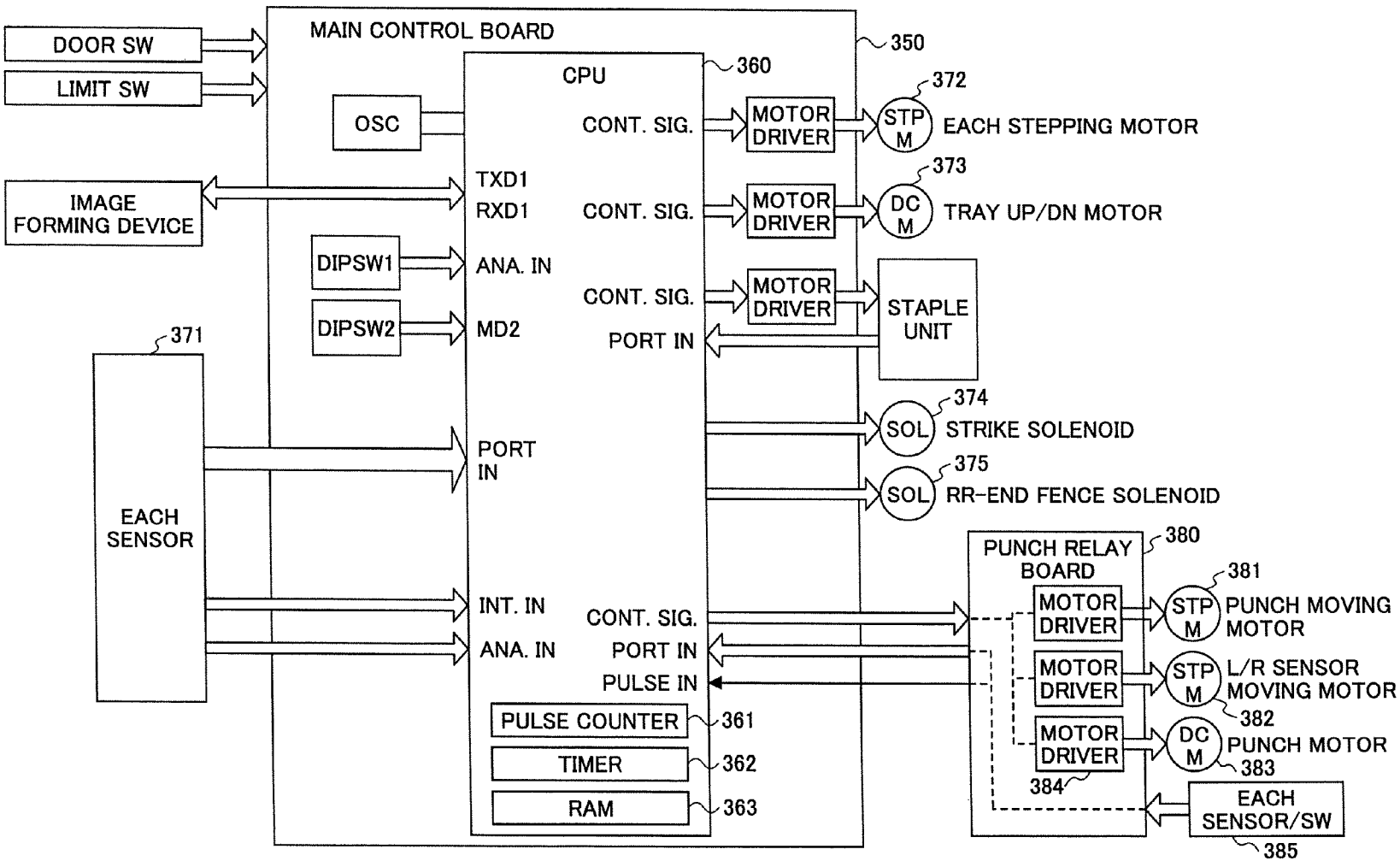
FIG. 11 is a block diagram of the control circuit of the sheet processing device of the present embodiment and the image forming device.

FIG. 11 shows the control circuit of the sheet processing device FR of the present embodiment and the image forming device.

As shown in FIG. 11, the main control board 350 is the control unit of the sheet processing device FR, and comprises the microcomputer, which mainly includes the CPU 360, and the CPU 360 comprises the pulse counter 361, the timer 362 and the RAM 363.

Each switch of the control panel of the image-forming-device PR main part etc., and the entrance sensor 301, the upper ejection sensor 302, the roller shift sensor 303, the staple ejection sensor 305, the staple tray paper existence sensor 306, the discharge lug position detection sensor 307, the ejection sensor 308, the space detection sensor 309, the middle folding unit paper existence detection sensor 310.

The output signals from the sensor 371 of the middle folding roller arrangement detection sensor 311, the middle folding and the stopper position detection sensor 312, and the paper existence detection sensor 313 are inputted into the CPU 360.

The CPU 360 manages the control of the various motors 372,373, the solenoid 374,375, etc. based on the inputted signal. Moreover, it is CPU 360 when the punch unit 3 also controls the clutch and the motors 381, 382 and 383 are controlled through the motor driver 384 according to the signal sent from the sensor or the switch 385 through the punch relay substrate 380.

In addition, control of sheet processing device FR is performed by performing the program written in ROM which the CPU 360 does not illustrate, using RAM 363 as a work area. Moreover, the computer program may be beforehand stored in the ROM or it replaces with this, and through the network, the recording medium, such as the server to CD-ROM and SD card, can be loaded to the recording-medium driving gear, and can be downloaded or upgraded to the hard disk drive unit (not illustrated).

Figure 12:
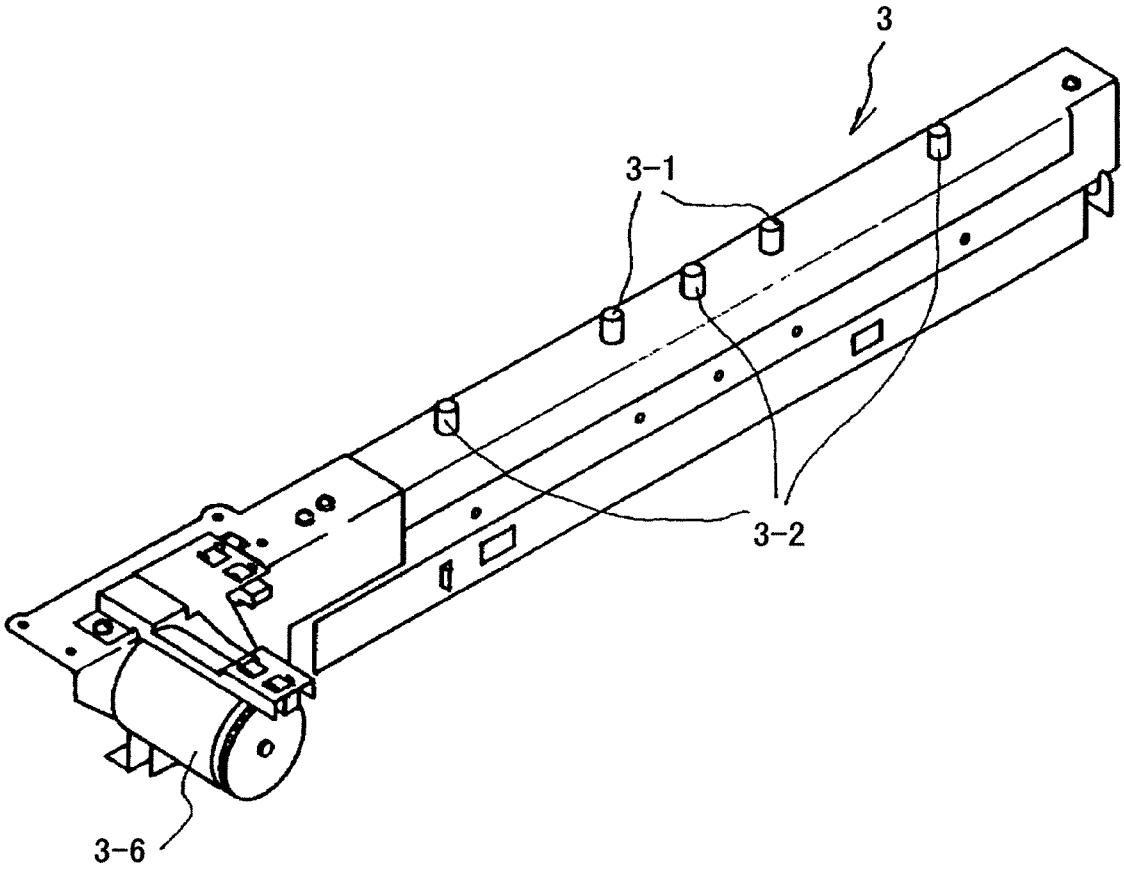
FIG. 12 is a perspective view of the punch unit in an embodiment of the present invention.
Figure 13:
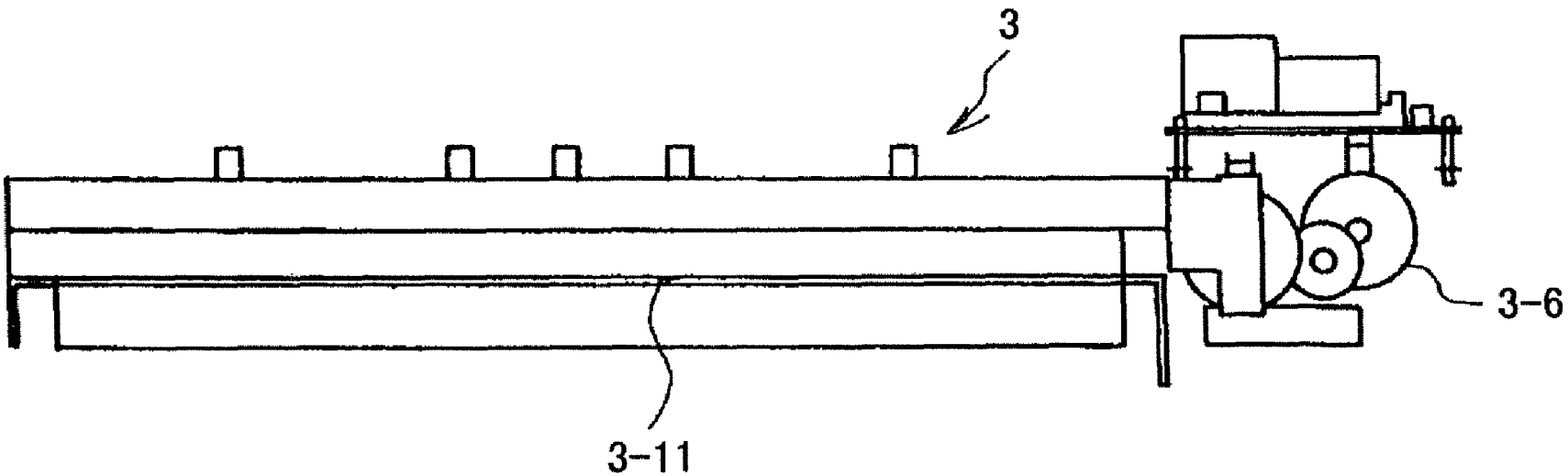
FIG. 13 is a side view of the punch unit of FIG. 12.
Figure 14:
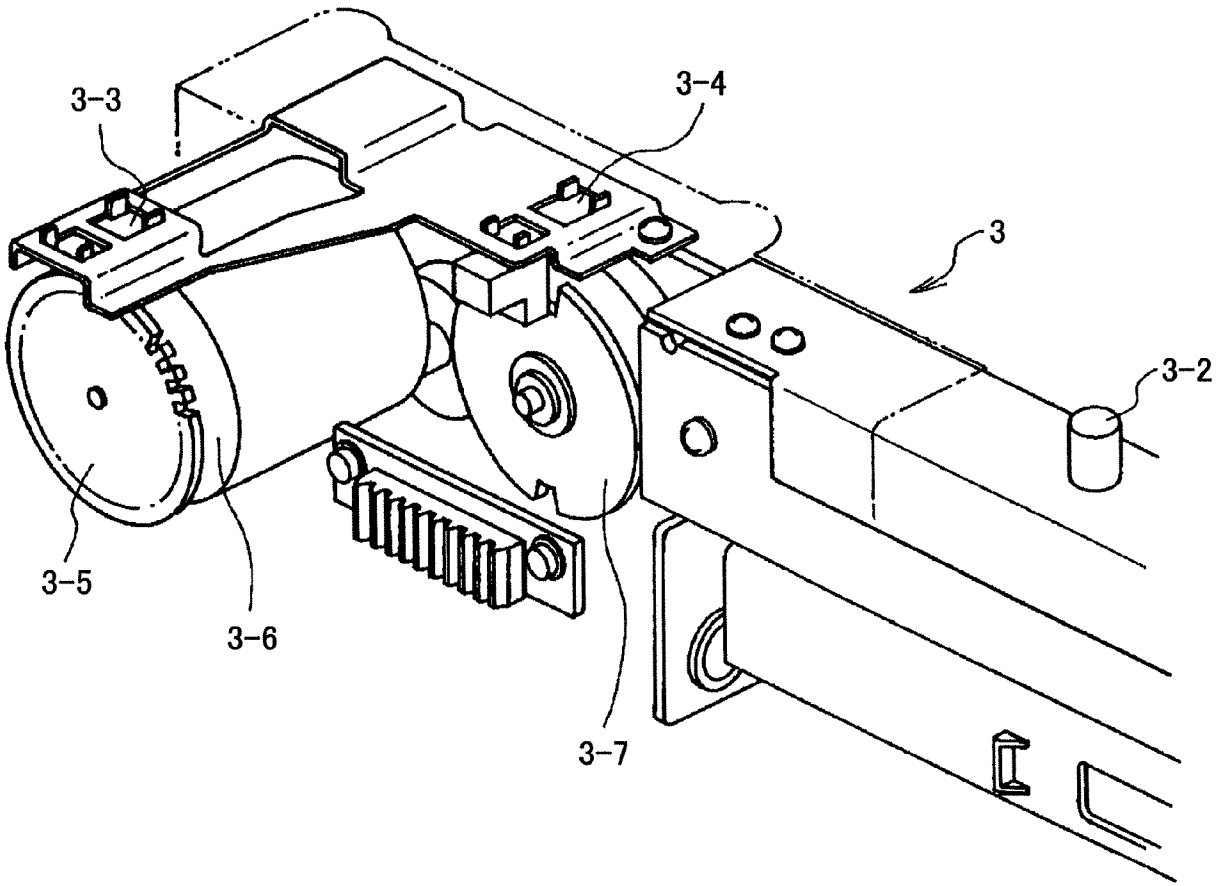
FIG. 14 is an enlarged view of the punch motor in the punch unit of FIG. 12.
Figure 15:
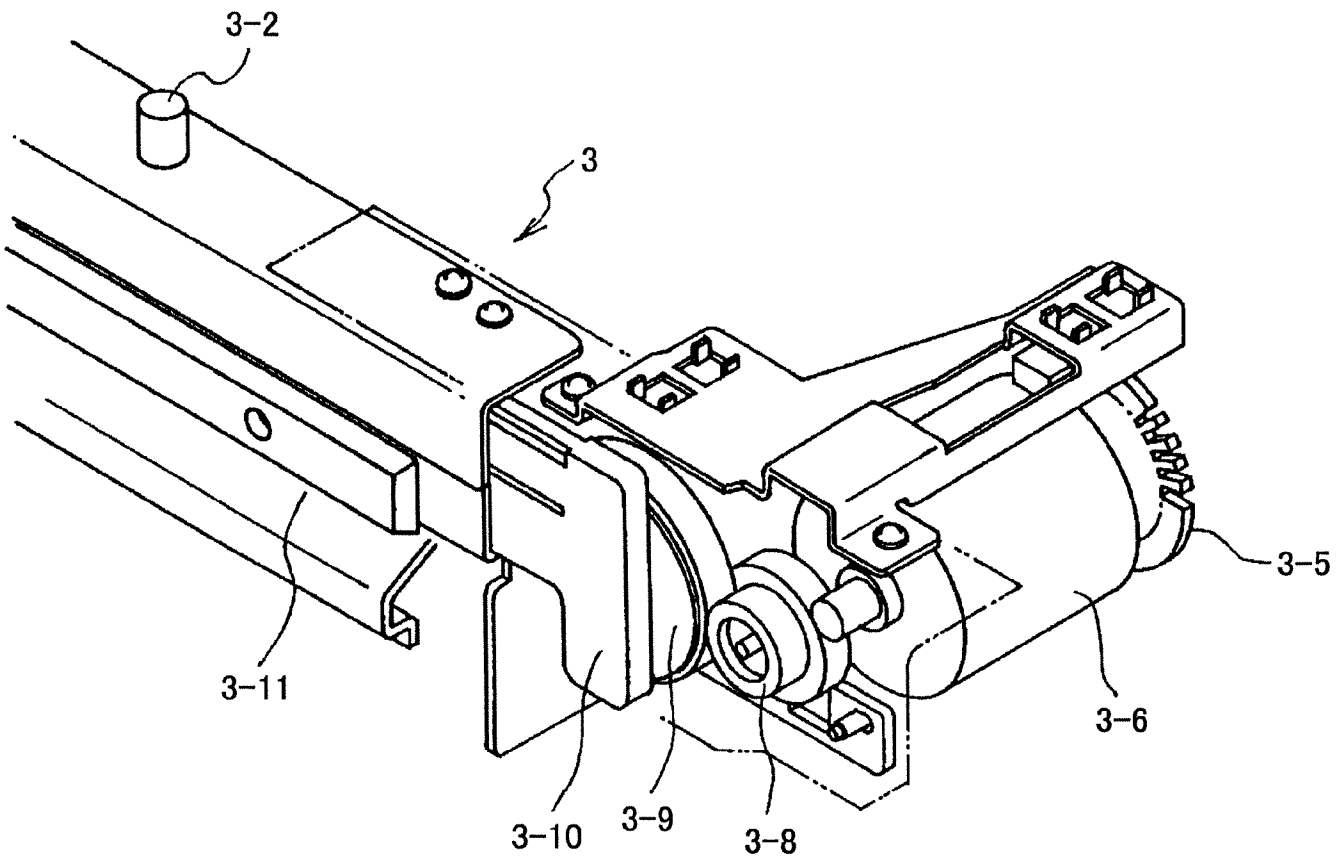
FIG. 15 is an enlarged view of the drive transfer mechanism in the punch unit of FIG. 12.

FIG. 12 is a perspective view of the sheet punch device in one preferred embodiment of the present invention. FIG. 13 is a side view of the punch unit of FIG. 12. FIG. 14 is an enlarged view of the punch motor in the punch unit of FIG. 12. FIG. 15 is an enlarged view of the drive transfer mechanism in the punch unit of FIG. 12.

As shown in FIG. 12, the punch unit concerning this embodiment is the punch unit which can punch the two holes (3-1) and the three holes (3-2), and that of selection of whether it punches in the two holes or to punch in the three holes and the drive at that time is equivalent to that of Japanese Laid-Open Patent Application No. 2002-337095, and since it is well-known technology, and a description thereof will be omitted.

The sheet conveyed by sheet processing device FR is the punch unit from the gap 3-11 of FIG. 13. It advances into 3 and punching operation is performed. The DC brush motor (punch motor) 3-6 which is shown as the DC motor shown in FIG. 14 is the driving source of punching. As shown in FIG. 15, when the DC brush motor 3-6 rotates, the gear 3-8 and the crank gear 3-9 are rotated, and the slide link 3-10 slides to right and left.

By the slide of the slide link 3-10, they are the punch edge 3-1 or 3-2 moves up and down and punching operation is performed.

The well-known mechanism in which the mechanism in which the slide is transmitted to vertical movement of the punch, which is disclosed in Japanese Laid-Open Patent Application No. 2002-337095, is used.

If the DC brush motor 3-6 of FIG. 14 rotates, the encoder 3-5 attached on the axis of DC brush motor 3-6 will rotate, and the output of the pulse-count sensor 3-3 will change.

As shown in FIG. 11, the output of the sensor 385 is inputted from the pulse-input port of CPU 360, and is counted by the pulse counter 361 in CPU 360.

The home-position filler 3-7 is attached on the axis of the crank gear 3-9, and it is provided so that when the punch edge 3-1 or 3-2 is in the home position (where the punch edge does not project toward the gap 3-11 from the lower frame), the home-position sensor 3-4 may detect the end (the cut-out) of the home-position filler 3-7. The cut-out of the home-position filler 3-7 is arranged at each of the positions where they counter each other 180 degrees (a total of the two cut-out ends) and at each position the punch edge does not project toward the gap 3-11 from the lower frame.

If the punch edge 3-1 or 3-2 makes it half-rotate and stops the home-position filler 3-7 from the state of the home position, according to the rotation direction, either the punch edge 3-1 or 3-2 performs punching operation (vertical movement), and it will be in the state of the home position again.

If last time and the opposite direction are made to rotate DC brush motor 3-6 from this state, the same punch edge (3-1 or 3-2) as last time will perform punching operation again.

When rotating DC brush motor 3-6 in last time and this direction, the punch edge (3-1 or 3-2) different from last time performs punching operation.

The problem in using the DC brush motor 3-6 for the source of power is the deterioration of the motor stop precision. When the motor stop operation is completely performed from punching in the same control, the stop position is sharply changed by the variation in the variation in the property of the motor, the variation of the driver voltage, the difference in the thickness of the punching sheet, and the mechanical load between the units etc.

If the motor stop precision is poor, the punch edge will separate from the home position at the time of the stop, and fault will occur in paper conveyance etc.

Then, it controls by this embodiment as follows.

From immediately after motor rotation of punching operation, the pulse count is started by the pulse counter 361 in the CPU 360. With the rotation of DC brush motor 3-6, if the home-position filler 3-7 rotates, the home-position sensor 3-4 will detect the edge (home position OFF) of the home position cut and lacked. Storing the number of the pulse counts at this time in the memory Ps in CPU 360 (RAM 363) after that always the number of count pulses from the home-position sensor OFF getting it blocked the position of the punch edge 3-1 or the vertical direction of 3-2 can be known.

If the number of count pulses at a certain time is set to P, the number Pn of count pulses from the home-position sensor OFF will serve as Pn=P−Ps.

The thickness of the punching sheet is small with the high (the maximum near in power supply specification tolerance) driver voltage if the motor speed becomes quick for this reason, the stop position will become the tendency to overrun to the target.

On the contrary, the thickness of the punching sheet is large with the low (the minimum near in power supply specification tolerance) driver voltage if the motor speed becomes slow for this reason, the stop position will become the tendency to come to the front to the target.

Moreover, the stop position may change also with the temperature characteristics of the motor.

Then, in order to bring close to the stop position of the aim as much as possible always, the restart of the motor rectifies the stop position.

By the first motor drive operation, the sheet is punched, the brakes are applied and the motor is stopped. This first motor drive operation corresponds to motor drive operation of the beginning for punching operation. In the timing charts of FIG. 16 and FIG. 17, the timing from the first motor starting to the motor stop is indicated. The number of count pulses from the home position OFF serves as Pn=P−Ps, as mentioned above, and it sets Pn at the time of this motor stop to Pns.

On the other hand, when the target value of Pns is set to Ptg, the amount Pdev of pulse deviation at the time of stop of the first motor drive operation is computed according to the following formula.

$$Pdev=Pns-Ptg \quad (1)$$

When it overruns to the stop position of the target, it is set to Pdev>0, and it is set to Pdev<0 when it stops to the front. It is set to Pdev=0 when it is able to stop exactly in the stop position of the target.

Figure 16:
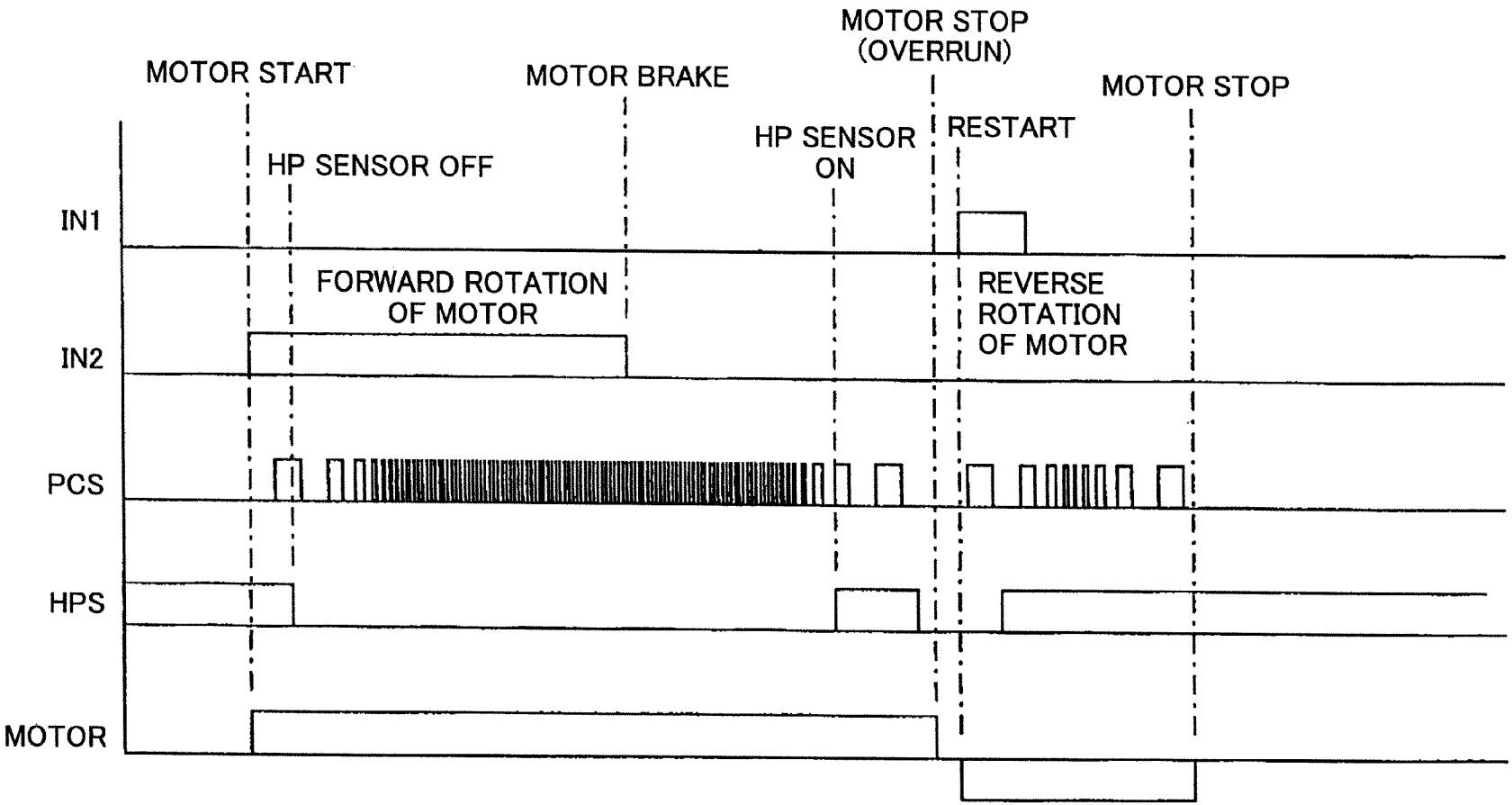
FIG. 16 is a timing chart for explaining the motor drive control function of a first preferred embodiment of the sheet punch device of the invention.
Figure 17:
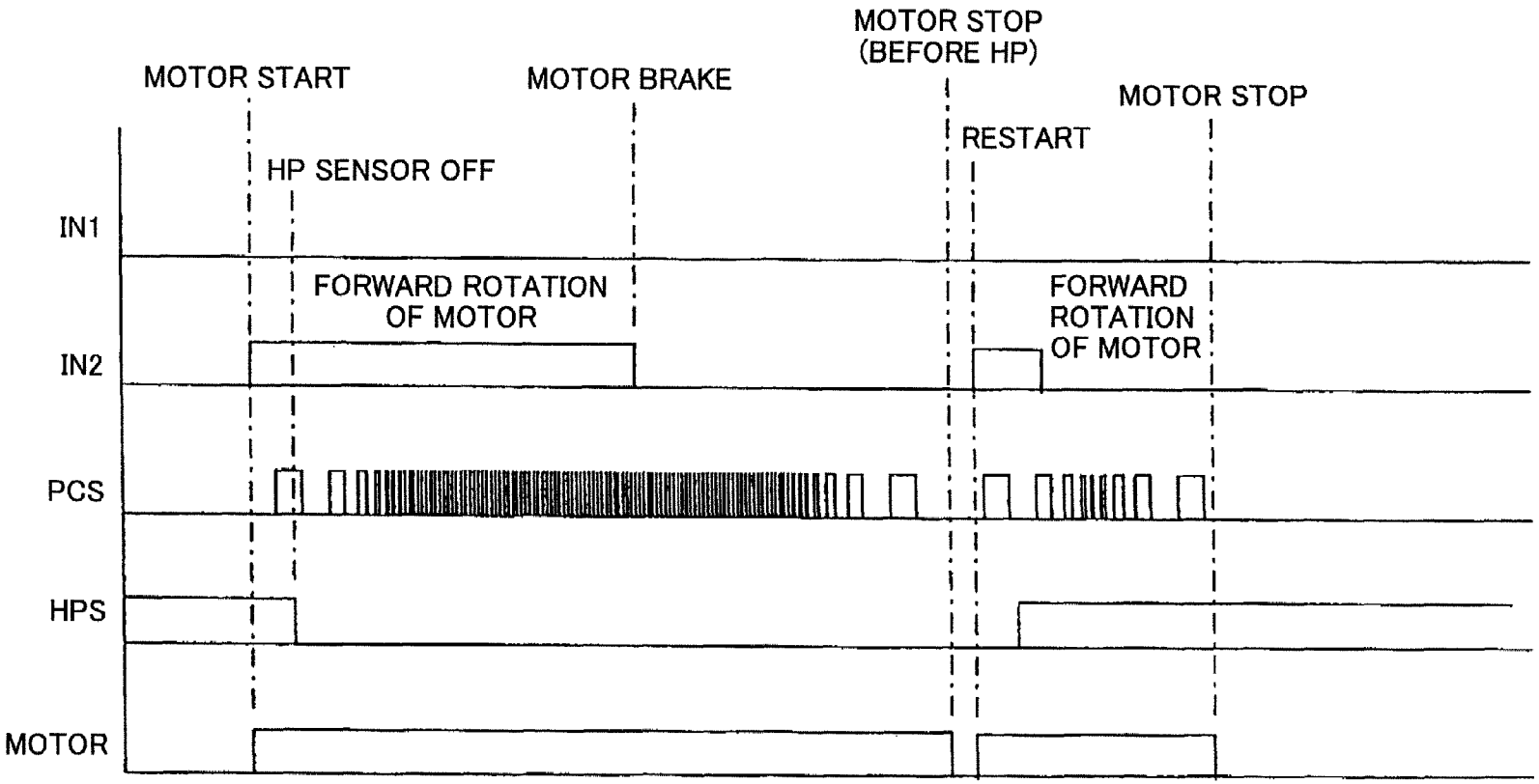
FIG. 17 is a timing chart for explaining a variation of the motor drive control function of the first preferred embodiment.

The time of Pdev>0 makes the opposite direction rotate the motor to the first motor drive operation, as the compensation by restart is shown in the timing chart of FIG. 16 and FIG. 17, since it is such (view 16), the motor is rotated in this direction to the first motor drive operation at the time of Pdev<0 (FIG. 17), and it brings the punch edge close to the stop position of the aim.

In addition, in the timing charts, the following timings are indicated:

IN1=L, IN2=H: forward rotation of motor

IN1=H, IN2=L: reverse rotation of motor

IN1=L, IN2=L: motor brake

PCS: the pulse-count sensor 3-3

HPS: the home-position sensor 3-4.

In addition, in the case of Pdev=0, the restart does not carry out. Even in the case where the punch edge is in the home position but Pdev is not equal to 0, there is no trouble in conveyance of the sheet or the next punching operation, it is not necessary to perform the restart.

By changing the amount of motor drive at the time of the restart according to the value of the amount Pdev of pulse deviation at the time of stop of the first motor drive operation, the punch edge can be brought to the target stop position more closely.

Then, assuming that Tad [ms] indicates the motor drive time at the time of the restart, the motor drive time Tad [ms] is calculated according to the following formula:

$$Tad=Kt\times Pdev \quad (2)$$

where Kt is the re-drive time compensation coefficient.

Namely, the motor is driven for the time Tad [ms], and by applying the motor brake after that, it can be brought close to the target stop position regardless of with the value of the amount Pdev of pulse deviation at the time of the first motor drive operation stop.

Figure 18:
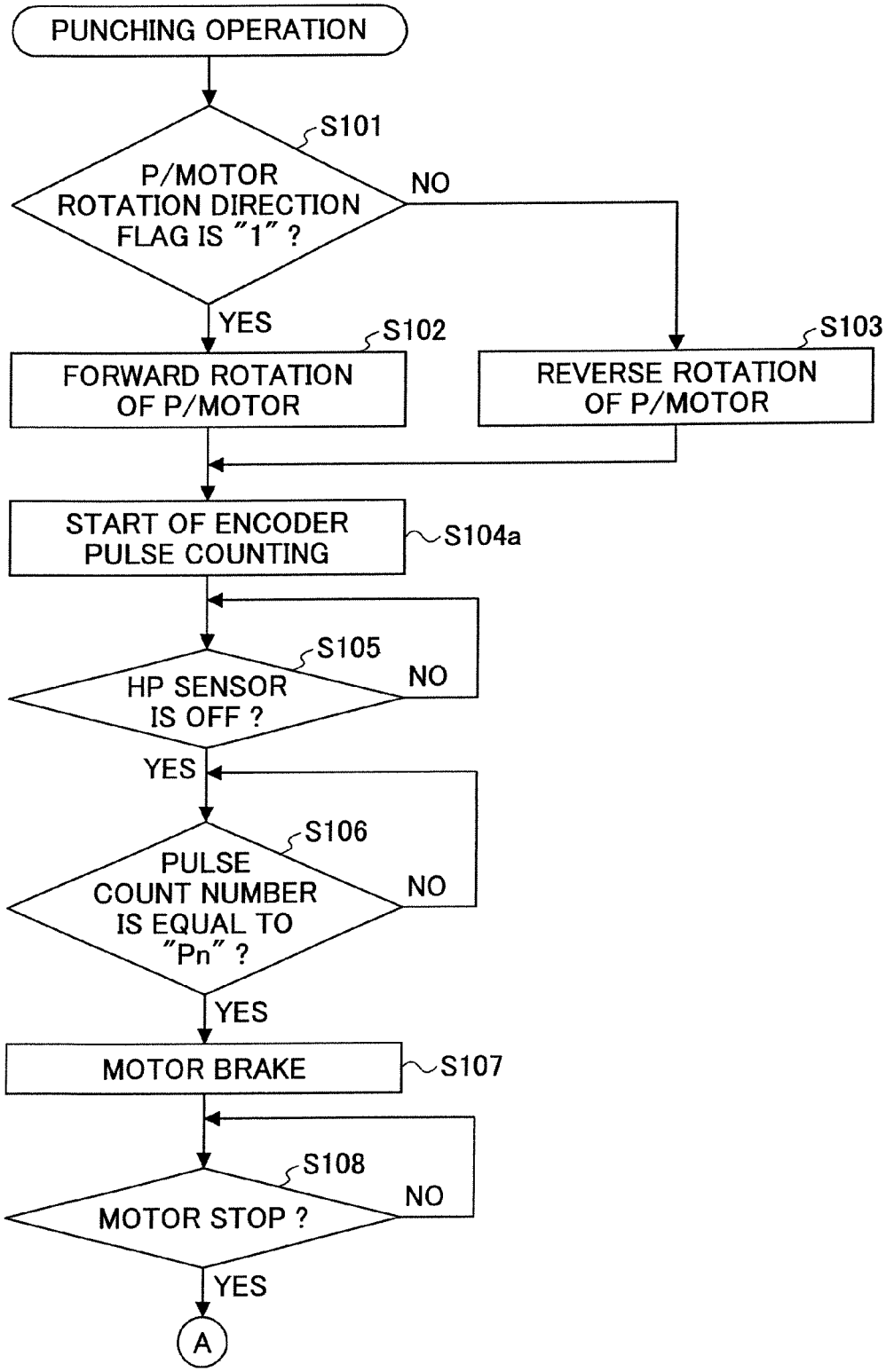
FIG. 18 is a flowchart for explaining a first half of the punching operation control procedure of the first preferred embodiment of the sheet punch device of the invention.
Figure 19:
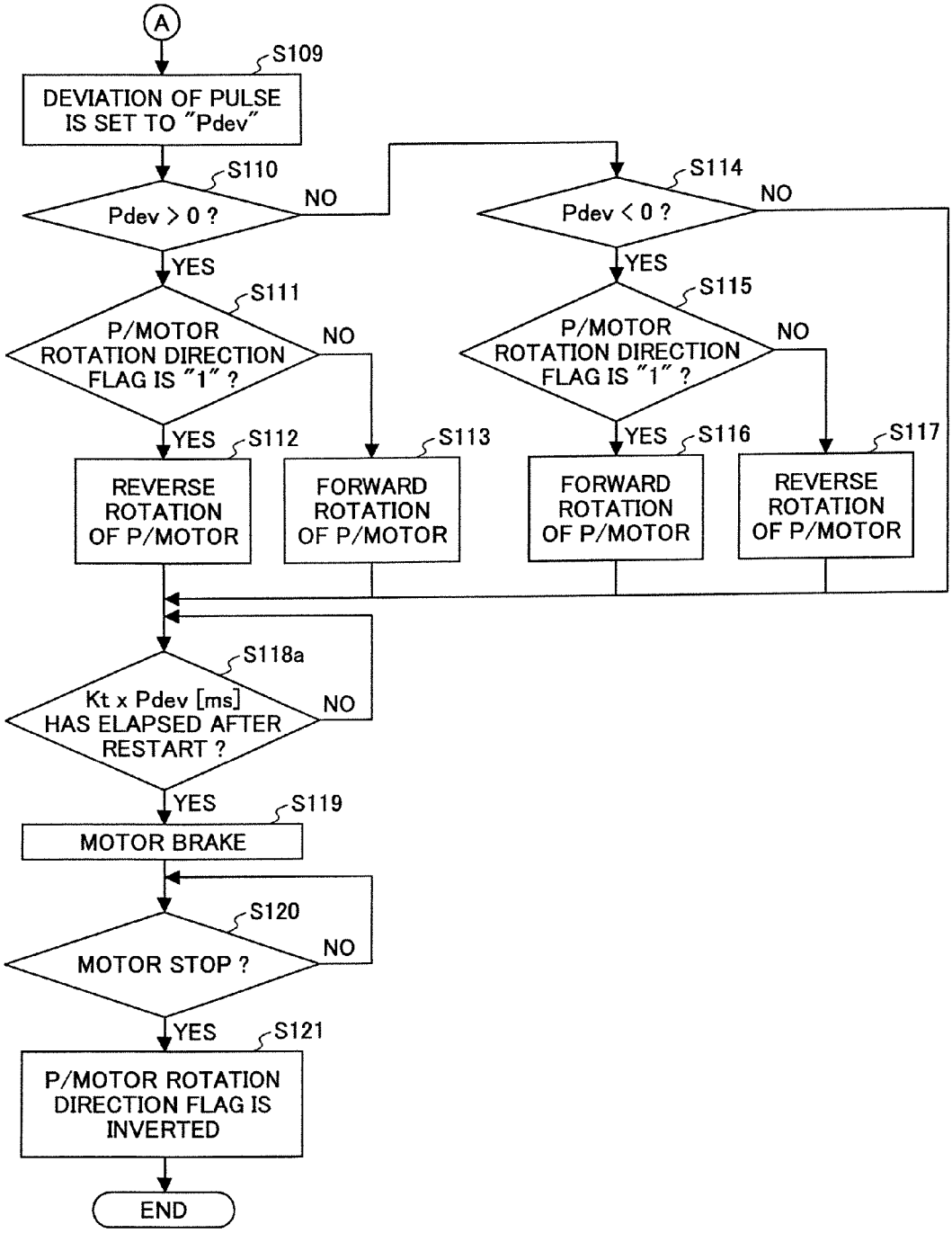
FIG. 19 is a flowchart for explaining a second half of the punching operation control procedure of the first preferred embodiment.

FIG. 18 and FIG. 19 are the flowchart for explaining the punching operation control procedure of the first preferred embodiment of the sheet punch device of the invention.

In addition, if the number of the driving pulses counted or the motor driven time is known, the amount of the motor drive can be measured using the number of the driving pulses or the motor driven time, and this measurement is carried out by the CPU 360.

In the control procedure of FIG. 18, the rotation direction flag of the punch motor 3-6 is checked as being equal to "1" (step S101).

The forward rotation of the punch motor 3-6 is performed if the result of the step S101 is affirmative (step S102). If the result of the step S101 is negative, the reverse rotation of the punch motor 3-6 is performed (step S103).

And the pulse counting of the encoder 3-5 is started by the pulse counter 361 (step S104*a*). The home-position sensor 3-4 is turned off, and the home position is detected (step S105). It is determined whether the pulse-count value of the encoder 3-5 is equal to "Pn" (step S106). When the result of the step S106 is affirmative, the motor brake is applied to the punch motor 3-6 (step S107).

And it is determined whether the punch motor 3-6 stops running (step S108). When the result of the step S108 is affirmative, the amount of pulse deviation at the time of the first motor drive operation stop is substituted for Pdev (step S109). It is determined whether the value of the Pdev is larger than zero (or whether the overrunning takes place) (step S110).

And the rotation direction flag of the punch motor 3-6 is checked as being equal to "1" (step S111). When the rotation direction flag is equal to 1, the punch motor 3-6 is reversely rotated (step S112). If the rotation direction flag is not equal to 1, the punch motor 306 is forwardly rotated. Then, the control will shift to the step S118*a*.

On the other hand, if the result of the step S110 is negative, it is determined whether the value of the Pdev is smaller than zero (step S114). If the result of the step S114 is negative (i.e., if it is Pdev=0), the control will shift to the step S118*a*. If the value of the Pdev is smaller than zero, the rotation direction flag of the punch motor 3-6 is checked as being equal to 1 (step S115). If the rotation direction flag is equal to 1, the punch motor 3-6 is forwardly rotated (step S116). If the rotation direction flag is not equal to 1, the punch motor 3-6 is reversely rotated (step S117). Then, the control will shift to the step S118*a*.

In the step S118*a*, it is determined whether the motor driven time Tad, calculated according to the above formula (2), has elapsed after the restart of the punch motor 3-6. If the result of the step S118*a* is affirmative, the motor brake is applied to the punch motor 3-6 (step S119).

And it is determined whether the punch motor 3-6 stops running (step S120). If the result of the step S120 is affirmative, the punch motor rotation direction flag is inverted (step S121). The control procedure is finished.

The control procedure of this embodiment is executed by the CPU 360 in accordance with the computer program which is stored in the storage device (such as the hard disk), the ROM or the non-volative memory (not illustrated). The program is loaded by reading it from the recording medium, such as CD-ROM (not illustrated) through the memory drive, or downloaded from the server through the network.

Next, a description will be given of the second preferred embodiment.

When measuring the amount of motor drive at the time of the restart, the count pulse may be measured instead of measuring the time. In such a case, the count pulse Pad is calculated according to the following formula.

$$Pad=Kp\times Pdev \quad (3)$$

where Kp is the re-driving pulse compensation coefficient.

That is, the motor is driven by the number Pad of motor-drive pulses, and by applying the brakes after that, it cannot be concerned with the value of the amount Pdev of pulse deviation at the time of stop of the first motor drive operation, but can bring close to the stop position of the target.

Figure 20:
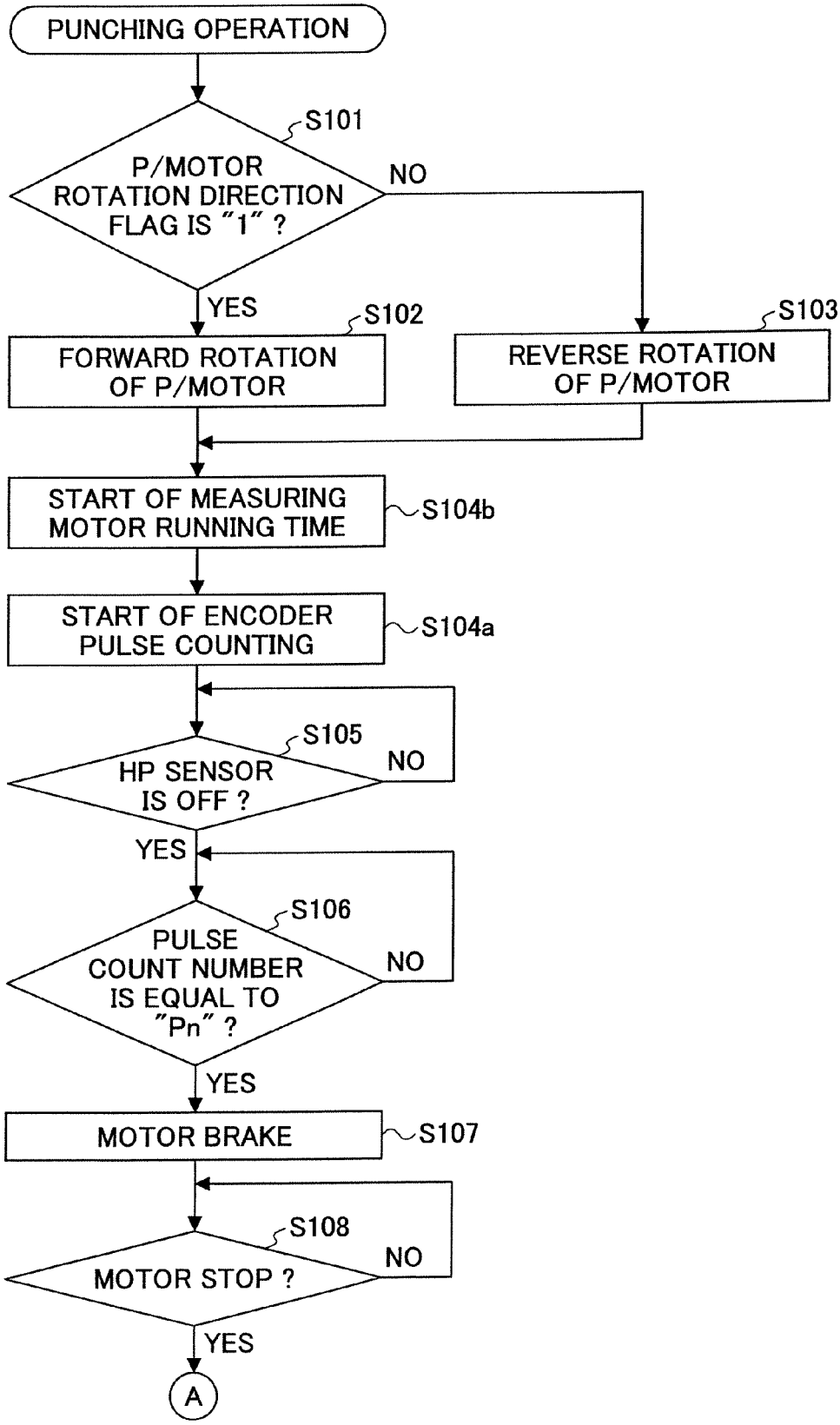
FIG. 20 is a flowchart for explaining a first half of the punching operation control procedure of a second preferred embodiment of the sheet punch device of the invention.
Figure 21:
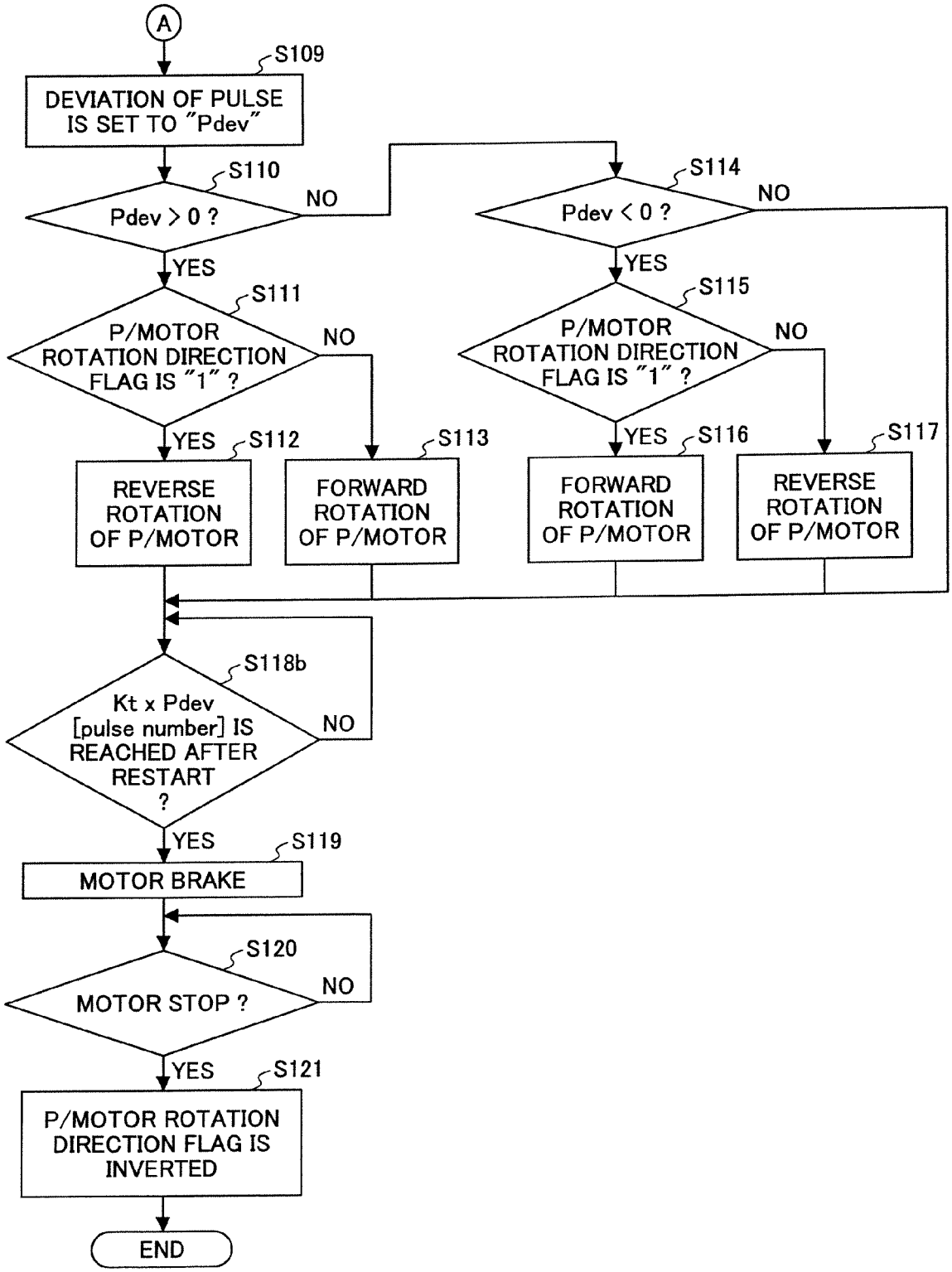
FIG. 21 is a flowchart for explaining a second half of the punching operation control procedure of the second preferred embodiment.

Thus, the procedure in the 2nd embodiment to process is shown in FIG. 20 and FIG. 21.

In addition, the explanation which the same reference sign is given to equivalent each part, and this 2nd embodiment overlaps since the processing only differs to the first embodiment is omitted.

The procedure shown in FIG. 20 and FIG. 21 adds motor drive timing-measurement start processing (step S104*b*) to the preceding paragraph of step S104*a* to the procedure shown in FIG. 18 and FIG. 19.

The counted value of the number Pad of the pulses which replaces with at the time of the step S118*a*, and is calculated by the above formula (3) being based (step S118*b*), it is what (step S119) set up the timing which applies the brakes to the punch motor 3-6. All other processings are the same as that of FIG. 18 and FIG. 19. In addition, especially each part that is not explained is constituted on a par with the first embodiment, and functions equally.

Next, a description will be given of the third preferred embodiment.

If the timing of the restart is made into the standard time T1 [ms] back from the first motor drive start, punch punching time can be shortened (from the first motor drive start to the restart end).

Temporarily, by the stop of the drive from the first motor drive start, supposing this time is 100 [ms], T1 will be set as 80 [ms]. In this case, the motor does not stop after T1 [ms] yet from the first motor drive start.

Figure 22:
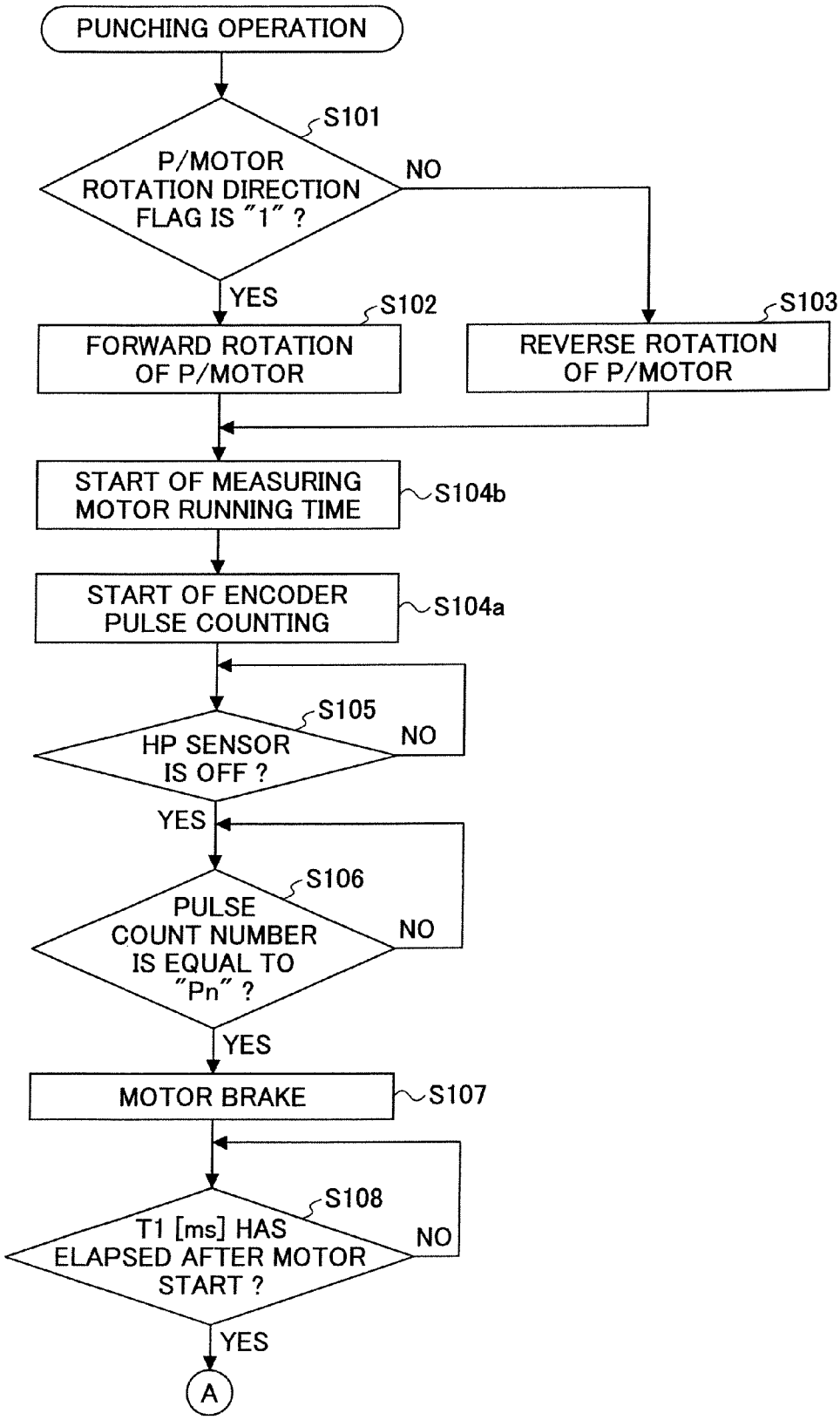
FIG. 22 is a flowchart for explaining a first half of the punching operation control procedure of a third preferred embodiment of the sheet punch device of the invention.
Figure 23:
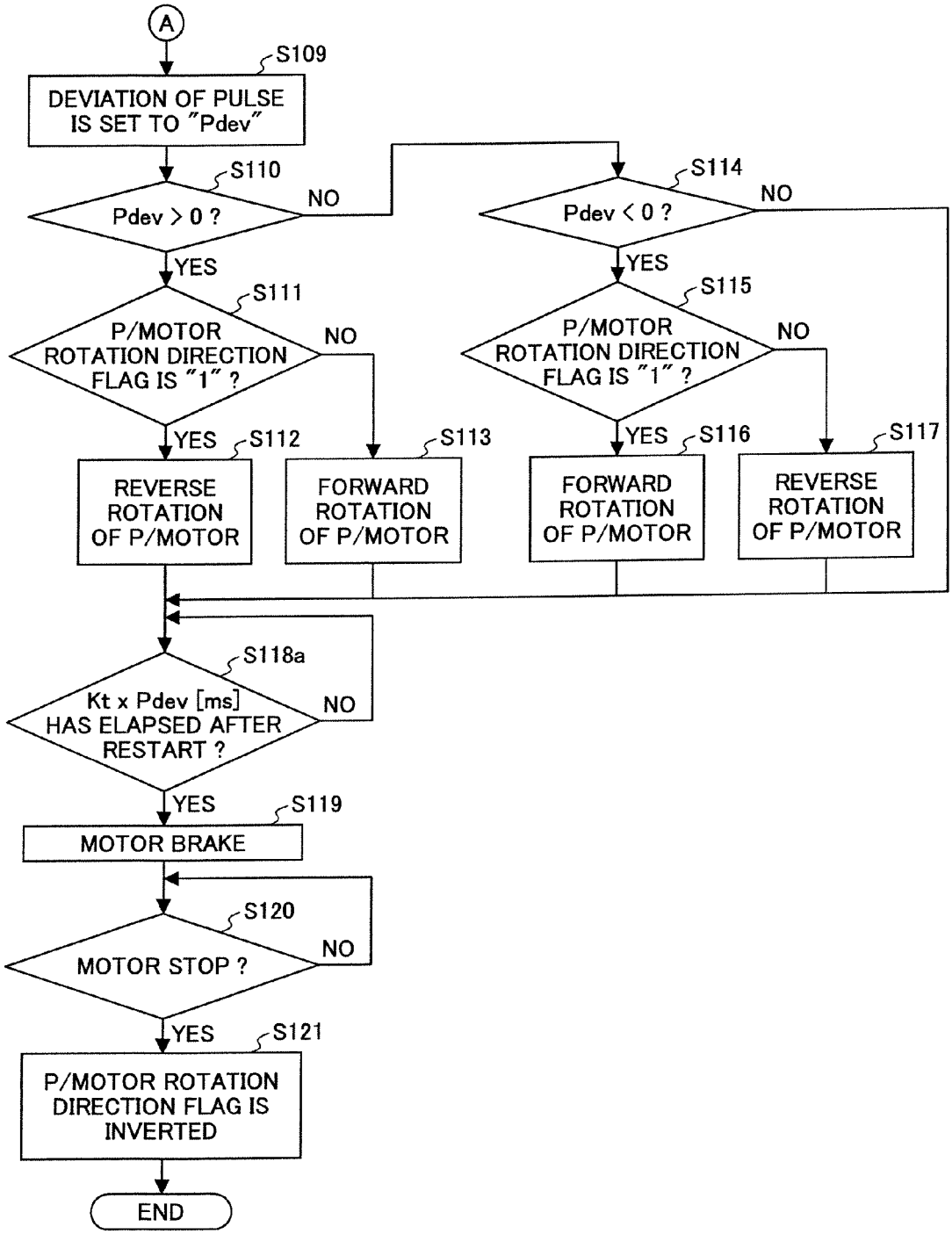
FIG. 23 is a flowchart for explaining a second half of the punching operation control procedure of the third preferred embodiment.

However, in the case of the DC brush motor, the drive speed in front of the stop is slowed down enough, and the amount of motor drives which moves by motor stop from T1 can be disregarded in many cases to the permissible variation of stop precision. Therefore, the amount Pdev of pulse deviation is detected at the time of T1 [ms], by performing the restart, it can bring close to the stop position of the target, and punch punching time can be shortened further (from the first motor drive start to the restart end). getting it blocked improvement in the speed of the device is attained. Thus, the procedure which can boil and set the 3rd embodiment to process is shown in FIG. 22 and FIG. 23.

Figure 24:
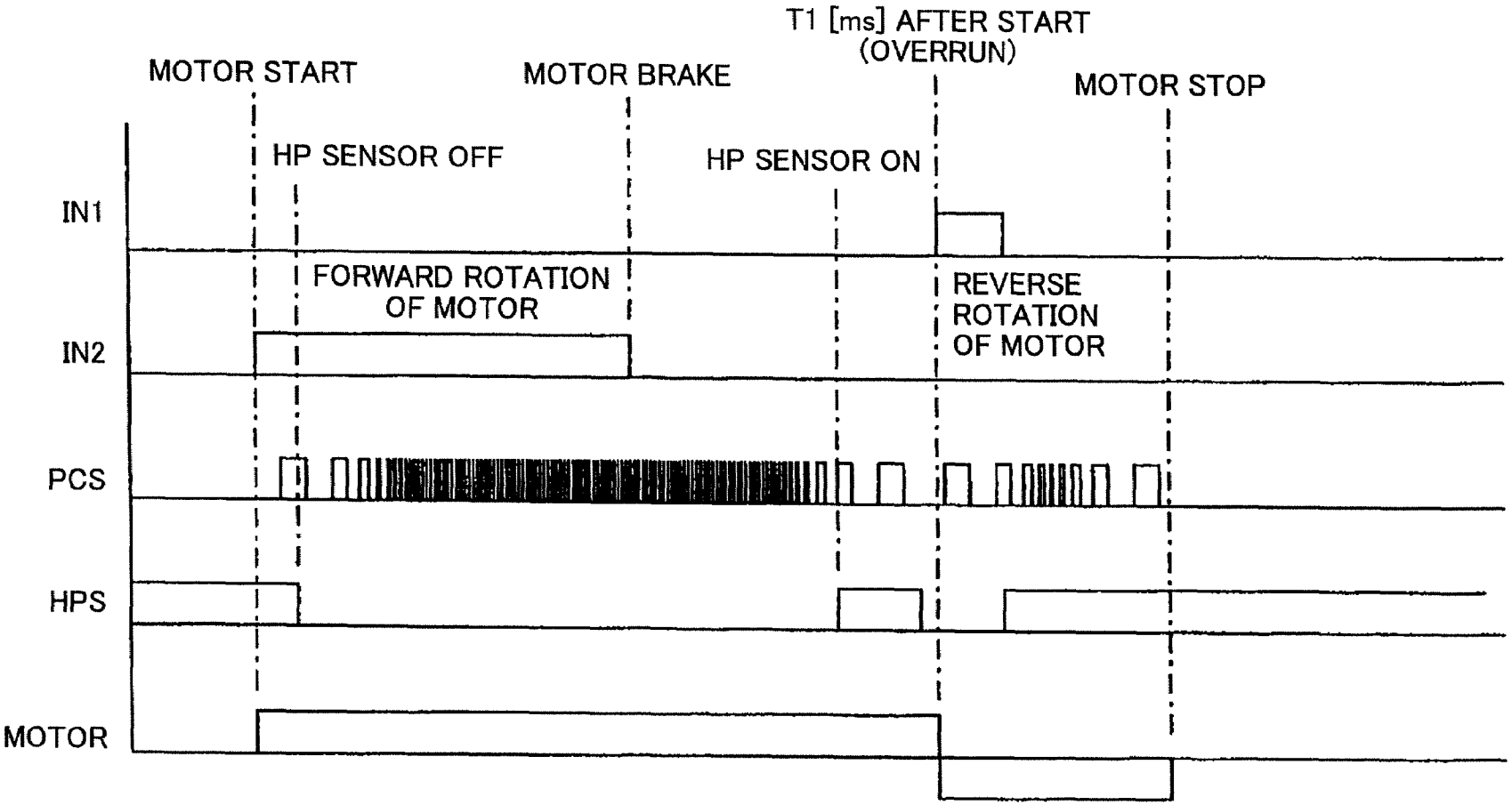
FIG. 24 is a timing chart for explaining the motor drive control function of the third preferred embodiment of the sheet punch device of the invention.
Figure 25:
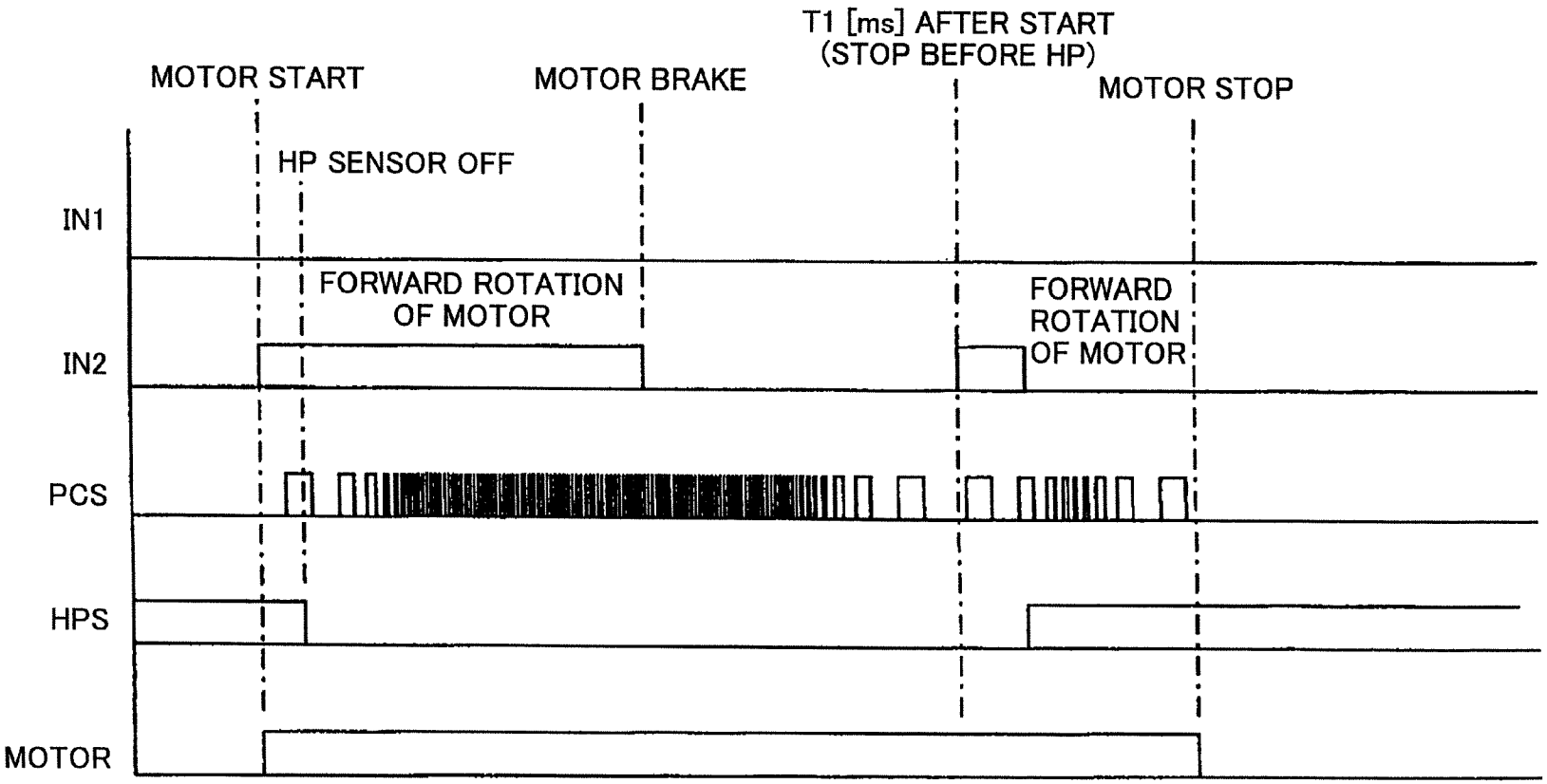
FIG. 25 is a timing chart for explaining a variation of the motor drive control function of the third preferred embodiment.

Moreover, they are FIG. 24 and FIG. 25 about the timing chart at this time.

In addition, the points (step S108*a*) which confirm whether the standard time T1 [ms] progress of this 3rd embodiment is carried out from the first motor drive start in step S108 to the 2nd embodiment only differ.

Since all other processings are the same as that of FIG. 20 and FIG. 21, the overlapping explanation is omitted.

In addition, since the time lag will be lost by the time it is rotated forwardly or reversely from the motor stop as shown in FIG. 24 and FIG. 25, it turns out the part and that it is shortened.

Even when the stop position of the target is restarted as a center of the home position since the motor did not stop after T1 [ms] yet from the first motor drive start as mentioned above, it is possible to stop in the position overrun somewhat.

In this case, the stop position of the target is set up to the front than the original stop position. Specifically, the value of Ptg of the above formula (1) is set to a value smaller than the original target Ptg. The value of Pdev is calculated according to the above formula (1), and the amount of motor drive at the time of the restart is determined according to the above formula (2) or (3), so that the sheet can be brought close to the stop position of the original target.

In addition, the parts in the present embodiment which are essentially the same as corresponding parts in the first preferred embodiment are designated by the same reference numerals and a description thereof will be omitted.

Next, a description will be given of the fourth preferred embodiment.

Although the punch edge can be brought close to the stop position of the target according to the embodiment explained until now, in order to perform the restart, the punching time becomes long compared with the time of not performing the restart.

Although it is safe to wait to the stop of the restart and to start conveyance of the punching sheet when the device is not so high-speed, conveyance of the sheet which punched before the motor stop of the first motor drive operation is started to accelerate the device.

The sheet is not caught in the punch edge even if it conveys the punching sheet since the punch edge does not project about the gap 3-11, when punching of the sheet is performed by the first motor drive operation and the punch edge goes into the home position by it.

Although the punch edge (3-1 or 3-2) different from last time projects about the gap 3-11 as mentioned. above if the first drive operation overruns and it goes too far beyond the home position, by then, the punching sheet moves and there is no punch hole just under the punch edge.

Therefore, the edge of the punch hole of the sheet is not caught in the edge of a blade of the punch, and sheet conveyance can be continued satisfactory.

If the amount of overrun is too large, although new punching will be performed by the punch edge different from last time, stop precision does not vary to there in fact.

Figure 26:
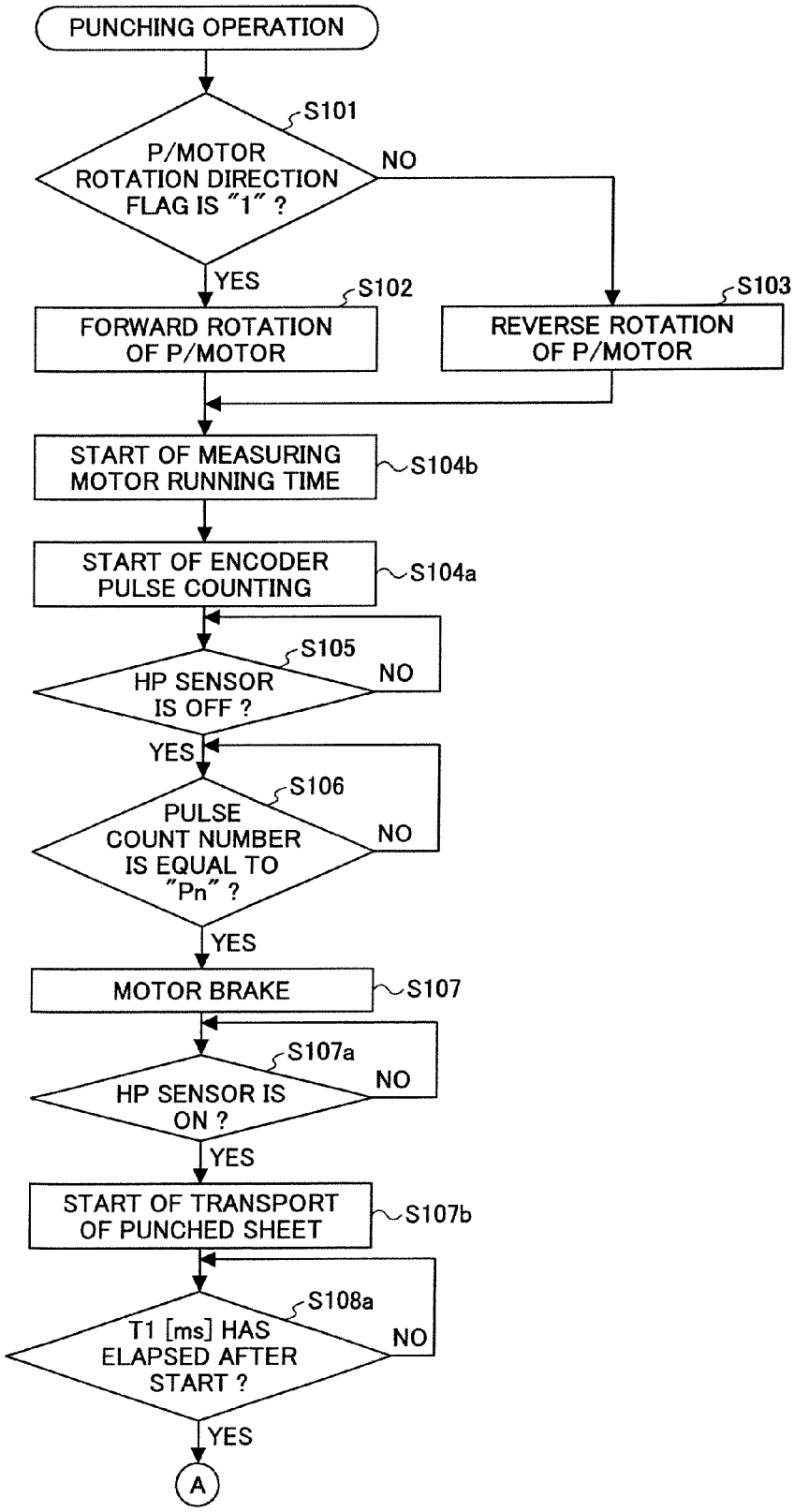
FIG. 26 is a flowchart for explaining a first half of the punching operation control procedure of a fourth preferred embodiment of the sheet punch device of the invention.
Figure 27:
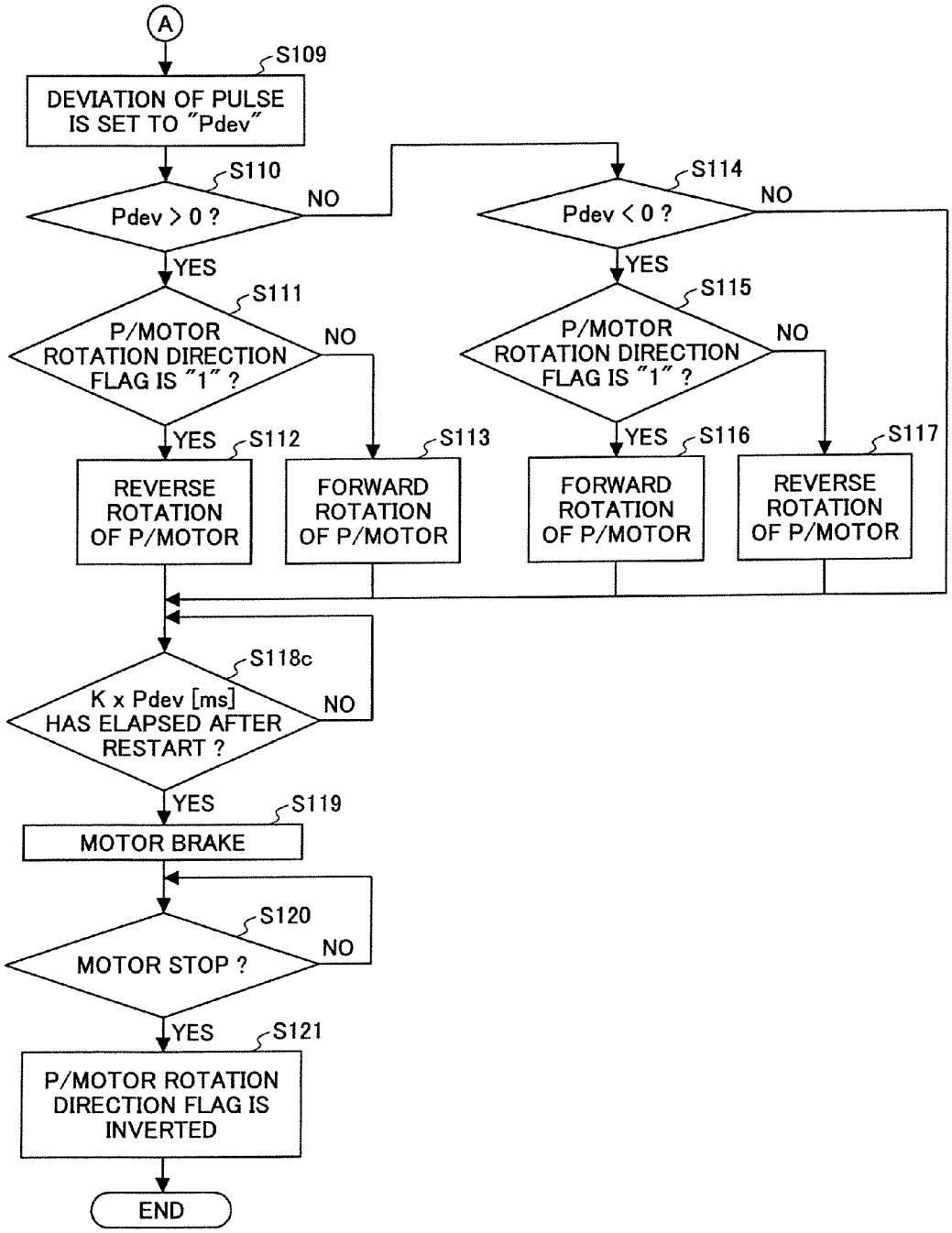
FIG. 27 is a flowchart for explaining a second half of the punching operation control procedure of the fourth preferred embodiment.

Then, the procedure in the 4th embodiment which performs such processing is shown in FIG. 26 and FIG. 27.

In the control procedure of FIG. 26 and FIG. 27, the points which put in processing of step S107*a* and S107*b* between step S107 and step S108*a* to the 3rd embodiment, replaced with processing of step S118*a*, and are considered as processing of step S118*c* only differ, only the processing is explained and the overlapping explanation is omitted.

That is, in the present embodiment, if the home-position sensor 3-4 is turned on and the punch edge is in the state where it does not project from the gap 3-11 after applying the brakes to the motor at step S107, the conveyance of the punched sheet will be started (step S107*b*), and the time from the first motor drive start will check (step S108*a*).

Moreover, in step S118*c*, when the time K×Pdev [ms] has elapsed after the restart, the brakes are applied to the punch motor (step S119).

However, K is the compensation coefficient in this case, and is the value experimentally asked for the compensation to store.

Although the time or subsequent ones of punching of the sheet being performed in the first motor drive operation as mentioned above, and the punch edge going into the home position is safe, the conveyance start timing of the punching sheet may be the front more, as long as it is checked in the experiment that the edge of the punch hole of the punching document is not caught in the edge of a blade of the punch edge.

It is good to delay the brake starting position so that punching of the sheet is performed by the first motor drive operation, and the stop position of the first motor drive operation may not become home-position this side, when starting paper conveyance after the time of the punch edge going into the home position.

As mentioned above, the position of the punch edge can be detected by count pulse several Pn=P−Ps from the home position OFF, and the compensation is attained based on this.

And the time measurement of the predetermined time under motor drive is carried out by using the timer 362 (which is not illustrated), and measure by the amount detection unit of motor drives in stop operation of the first motor drive operation the motor drive of the beginning for punching operation in predetermined time if the brake time of the reverse brake in motor drive operation of the beginning changes according to the working amount of motor drive. The stop precision of motor drive operation of 1 improves, and since the time which re-compensation takes becomes short, the device processing can be accelerated.

In the above-mentioned embodiments, it is desirable that the setting of Ptg of the above formula (1), the setting of Kt of the above formula (2), and the setting of Kp of the above formula (3) are determined to be the optimal value by using the experiment values with the actual device, the motor characteristics, etc.

Moreover, the amount of motor drive at the time of the restart is determined according to the above formula (2) or the above formula (3) as the example. However, it is desirable that the motor-drive amount is determined according to the optimal formula obtained from the experiment values with the actual device, the motor characteristics, etc.

Furthermore, it is desirable that the motor braking operation is performed by short-circuiting the motor (the two terminals of DC brush motor 3-6 are made to short-circuit in the motor driver shown in FIG. 3) from the standpoint of motor stop precision, or simple control.

However, the punching time can be shortened if the motor stop operation is performed by using the reverse braking operation for a fixed time and the short-circuiting operation after the fixed time.

In addition, the parts in the present embodiment which are essentially the same as corresponding parts in the first preferred embodiment are designated by the same reference numerals and a description thereof will be omitted.

Next, a description will be given of the fifth preferred embodiment.

Although there is also the method of making it into fixed time, if the time of the reverse braking operation changes the reverse braking time Trb [ms] according to the motor speed at a certain time, it can perform optimal brake control.

The measurement of motor speed can be checked in simple with the number Prs of count pulses of the fixed time Trs [ms] before the motor reverse braking starts. This is because the amount of motor drives per unit time becomes the motor speed.

When the motor speed is quicker and the reverse braking is applied for a long time, it is not based on the motor speed but the punching time can be shortened optimally. The inverted motor brake is applied for a long time when the motor speed is low, the motor may be reversed appropriately.

With the composition mentioned above, since the inversion state of the motor is undetectable, when the motor is reversed truly, subsequent re-compensation becomes impossible as the target.

Conversely, if the reverse braking operation is short when motor speed is quick, since the time to the motor stop will become long, punching time becomes long.

Moreover, if the motor restart timing is made into the fixed time back T1 from the first motor drive operation start, since the motor will not stop at the time of the restart, re-compensation precision becomes poor.

It is so better that the number Prs of count pulses is large to increase the reverse brake time Trb for this reason. For example, the formula used to compute the value of Trb is as follows.

$$Trb = Kb \times Prs \tag{4}$$

where Kb is the reverse brake time compensation coefficient.

Figure 28:
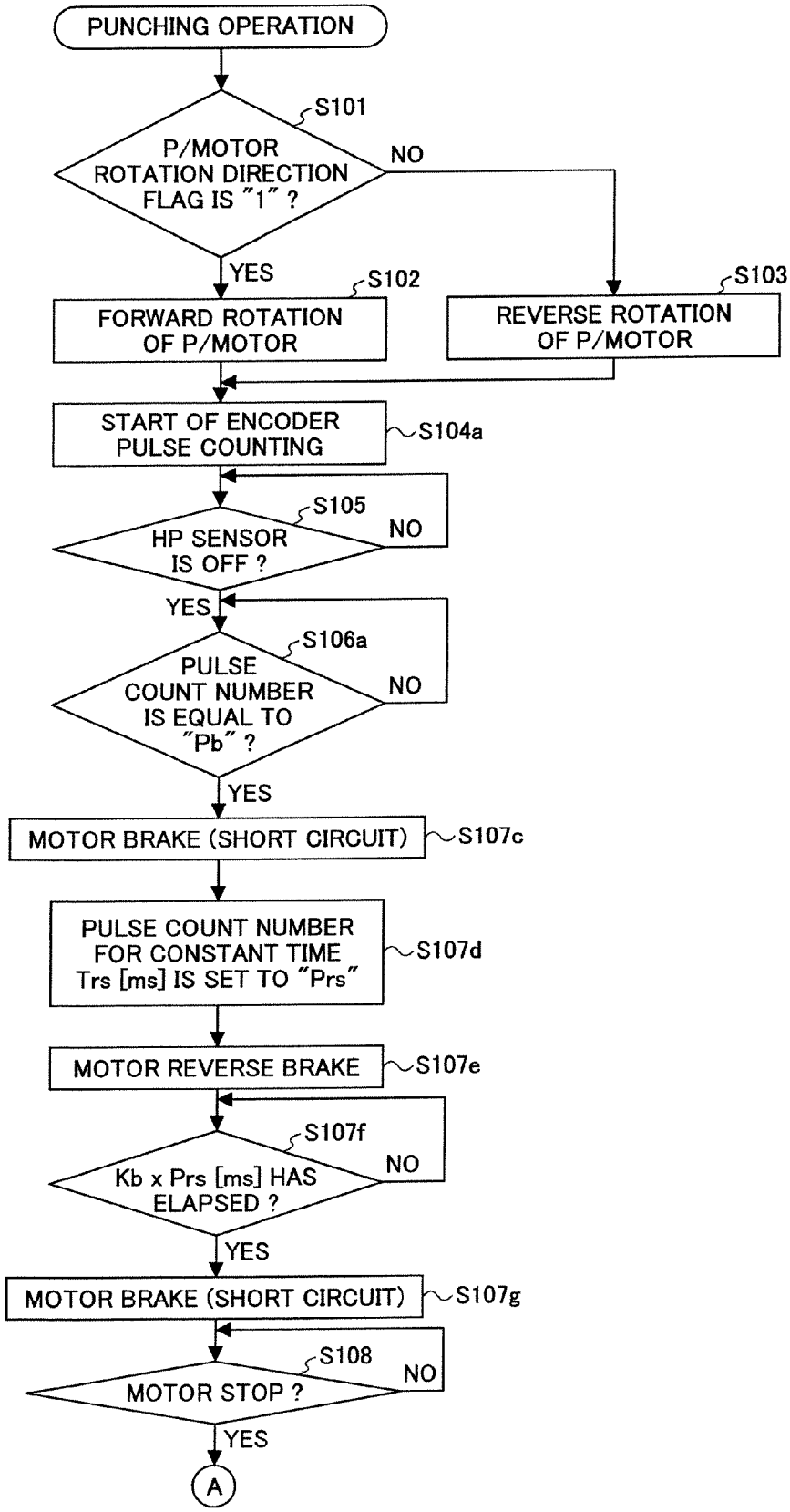
FIG. 28 is a flowchart for explaining a first half of the punching operation control procedure of a fifth preferred embodiment of the sheet punch device of the invention.
Figure 29:
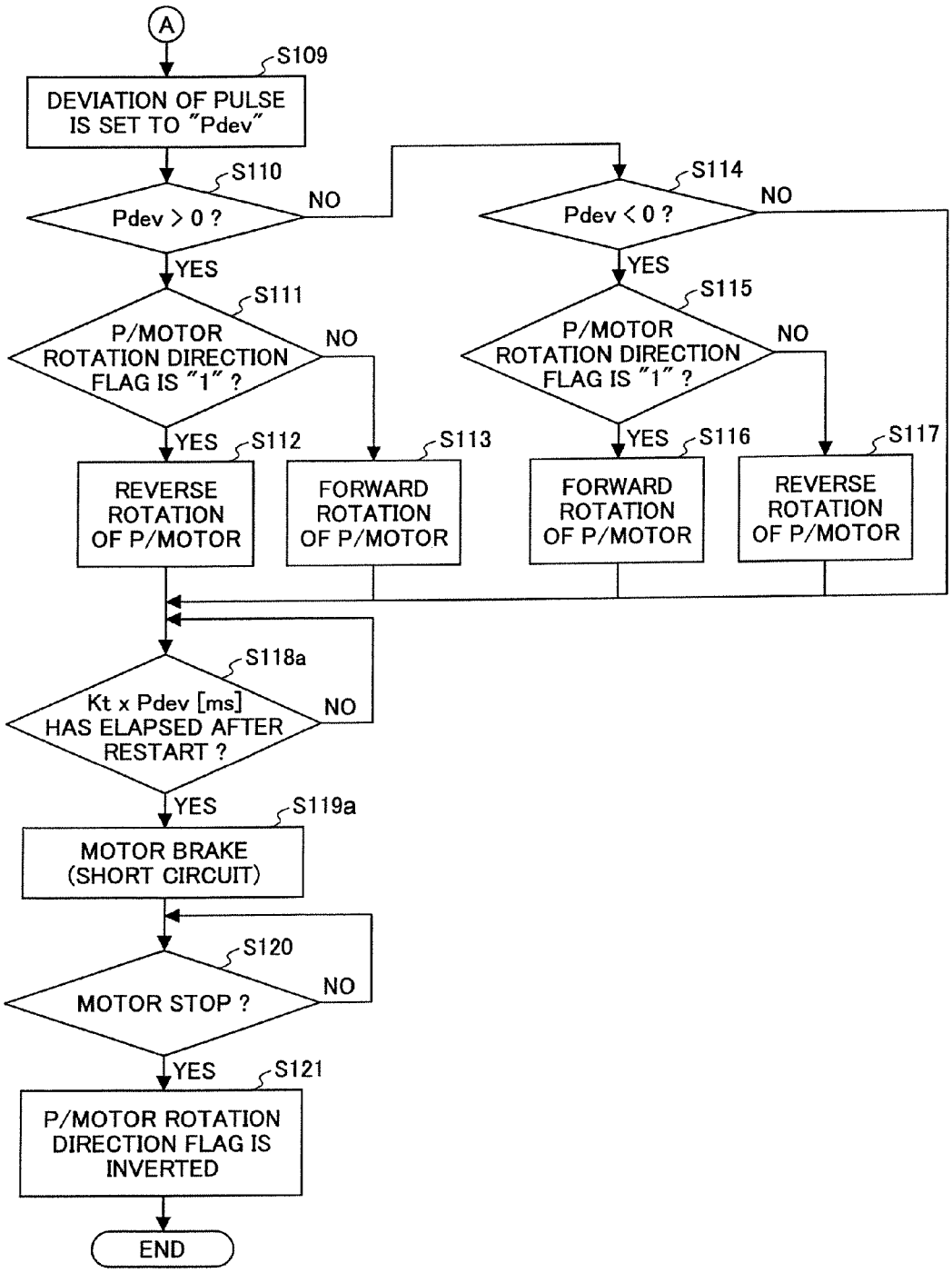
FIG. 29 is a flowchart for explaining a second half of the punching operation control procedure of the fifth preferred embodiment.

FIG. 28 and FIG. 29 are the flowchart for explaining the punching operation control procedure of the present embodiment of the sheet punch device of the invention.

In the control procedure of FIG. 28, the judgment of step S106 of FIG. 18 is replaced by the judgment of step S106*a*, and the processing of the motor brake of step S107 of FIG. 18 is replaced by the processing of step S107*c* through step S107*g*, and the processing of step S119 of FIG. 18 is replaced by the processing of step S119*a*, respectively. Only the differences of these steps from the control procedure of FIG. 18 will be explained.

That is, if the pulse-count value turns into the power value Pb to which motor brakes are applied in the step S106*a*, motor brakes will be applied by the short circuit brake (step S107*c*), the number of the pulses of the predetermined time Trs before the motor reverse braking operation start (fixed time) [ms] is counted (step S107*d*), and the motor reverse braking is applied as the number Prs of count pulses (step S107*e*).

And after the reverse braking starts, when the time Kb×Prs [ms] passes, the short-circuiting brake is applied (step S107*g*), and it is determined whether the motor stops running (step S108).

Then, the processing after step S109 is performed, and if the time Kt×Pdev [ms] passes after the restart in step S118*a*, the short-circuiting brake is applied (step S119*a*).

And if the motor stops (step S120), the punch motor rotation direction flag is inverted (step S121). Then the control procedure is finished.

Figure 30:
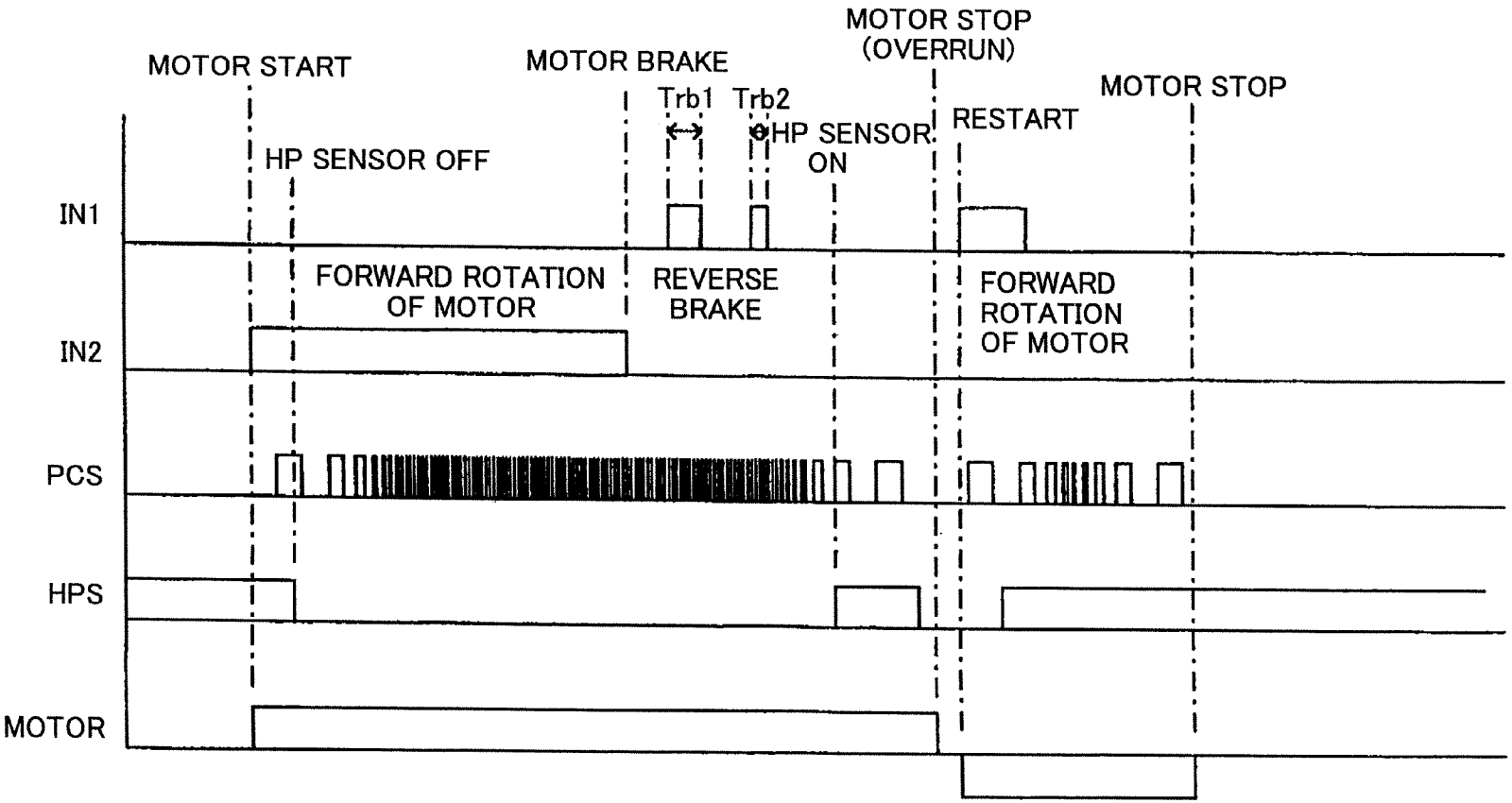
FIG. 30 is a timing chart for explaining the motor drive control function of the fifth preferred embodiment of the sheet punch device of the invention.
Figure 31:
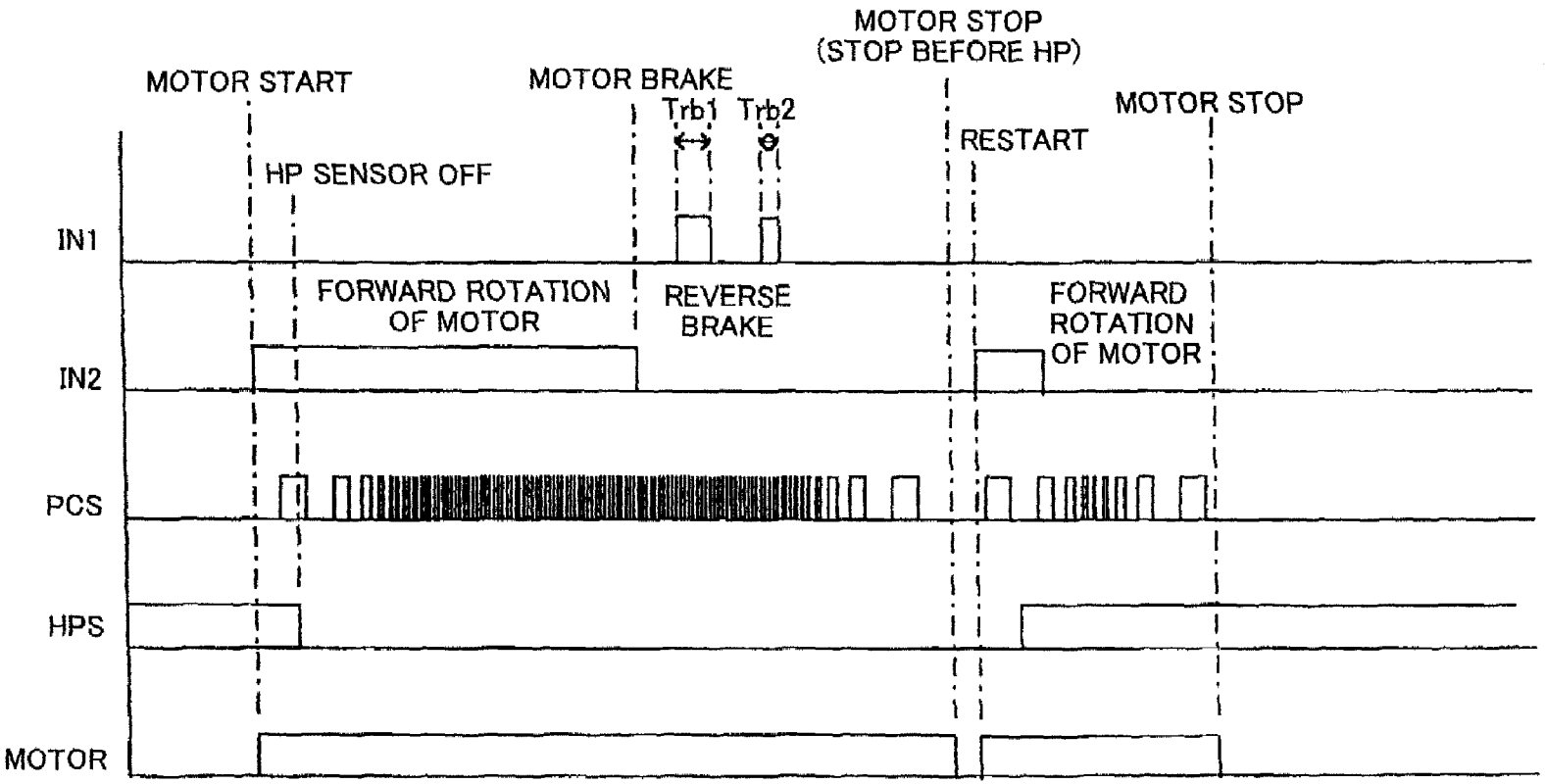
FIG. 31 is a timing chart for explaining a variation of the motor drive control function of the fifth preferred embodiment.

If the brake cannot be easily applied to the motor, when the motor temperature is high, by applying the reverse braking only, the motor stop operation may not be slowed down. In such a case, it is suitable to perform the reverse braking control two or more times, as shown in the timing charts of FIG. 30 and FIG. 31.

Moreover, if the reverse braking is applied for a long time when motor speed is slow, the motor may be reversed truly. If the motor stops, it will reverse certainly. If it reverses subsequent re-compensation aiming the passage it cannot do the sake motor speed very the degree being late or the time of stopping getting it blocked, it is better not to perform the reverse brake when the value of Prs is smaller than the reference point.

In addition, the parts in the present embodiment which are essentially the same as corresponding parts in the first preferred embodiment are designated by the same reference numerals and a description thereof will be omitted.

As mentioned above, the problem at the time of using the DC brush motor 3-6 for the source of power is the deterioration of the motor stop precision.

When the motor stop operation is completely performed from punching in the same control, the stop position is sharply changed by the variation in the variation in the property of the motor, the variation of the driver voltage, the difference in the sheet thickness, and the mechanical load between the units etc.

If the motor stop precision deteriorates, the punch edge will separate from the home position at the time of the stop, and fault will occur in paper conveyance etc.

Then, it controls by the 1 preferred embodiment of the present invention as follows.

Immediately after the motor rotation of punching operation, the timing measurement is started by the timer 362 in CPU 360.

The pulse count is simultaneously started by the pulse counter 361 in CPU 360. With rotation of DC brush motor 3-6, if the home-position filler 3-7 rotates, the home-position sensor 3-4 will detect the edge (home position OFF) of the home position cut and lacked.

The number of the pulse counts at this time is memorized in the memory Ps (RAM 363) in the CPU 360.

By performing in this way, the number of count pulses from the home position OFF, i.e., the position of the punch edge 3-1 or the vertical direction of 3-2, can be known after that at any time. If the number of count pulses at a certain time is set to P, the number Pn of count pulses from the home position OFF will serve as Pn=P−Ps.

Next, the number of the pulse counts at the time of the elapsed time from immediately after motor rotation of punching operation turning into the standard time Tr is memorized in the memory Ptr (RAM 363) in CPU 360.

Since the driver voltage is high (the maximum near [in power supply specification tolerance ]), or since the sheet thickness is small, when motor speed becomes quick, the stop position becomes the tendency which overruns to the target. At this time, the Ptr value becomes large.

On the contrary, since the driver voltage is low (the minimum near the required power supply), or since the sheet thickness is large, when motor speed becomes slow, the stop position becomes the tendency to come to the front to the target. At this time, the Ptr value becomes small.

Then, in order to bring close to the stop position of the target as much as possible always, the brake starting position is corrected.

Since it is in the tendency for the stop position to overrun to the target as mentioned above when the Ptr value is large, the brake starting position is made early.

On the contrary, since the stop position becomes the tendency to come to the front to the target when the Ptr value is small, the brake starting position is made later.

An example of the formula of the brake starting position is shown below.

If the pulse-count value of the brake starting position is set to Pb, the following formula will be drawn, in order the number of count pulses from the home position OFF is Pb−Ps, to bring forward and carry out the brake starting position when the Ptr value is large, and to make the brake starting position later, when the Ptr value is small.

$$Pb-Ps=Pd-K\times Ptr$$

Therefore, the pulse-count value Pb of the brake starting position can be calculated by using the following formula.

$$Pb=Pd+Ps-K\times Ptr \quad (5)$$

where Pd is the standard number of pulses, Ps is the number of the pulse counts at the time of the home position OFF, K is the compensation coefficient, and Ptr is the number of the pulse counts when the time Tr has elapsed after the motor drive.

In the above formula (5), the Ptr value is set to the number of the pulse counts when the time Tr has elapsed after the motor drive. Alternatively, it is also possible that the Ptr value is set to the number of the pulse counts between the time Tr1 and the time Tr2 after the motor drive. In this case, as for the optimum conditions to which stop precision becomes the best, it is desirable that the determination is made from the experiment values.

Moreover, although what is necessary is for the unit, the motor property, etc. just to determine the standard time Tr, it is set to about 30ms by this preferred embodiment.

The motor brake operation includes the field of stop precision to the desirable short circuit brake (the two terminals of DC brush motor 3-6 (it is the same as 383) are made to short-circuit by the motor driver 384 shown in FIG. 11).

However, the short circuit-after fixed time reverse brake−>fixed time brake can be operated, and punching time can be shortened by making it stop.

If the interrupt processing of CPU 360 is used as much as possible, stop precision of the start of each timing measurement and brake operation will improve further.

Moreover, as for the standard number Pd of pulses, and the compensation coefficient K, it is desirable to determine the optimal value from the experiment value with the unit, the motor property, etc.

Figure 32:
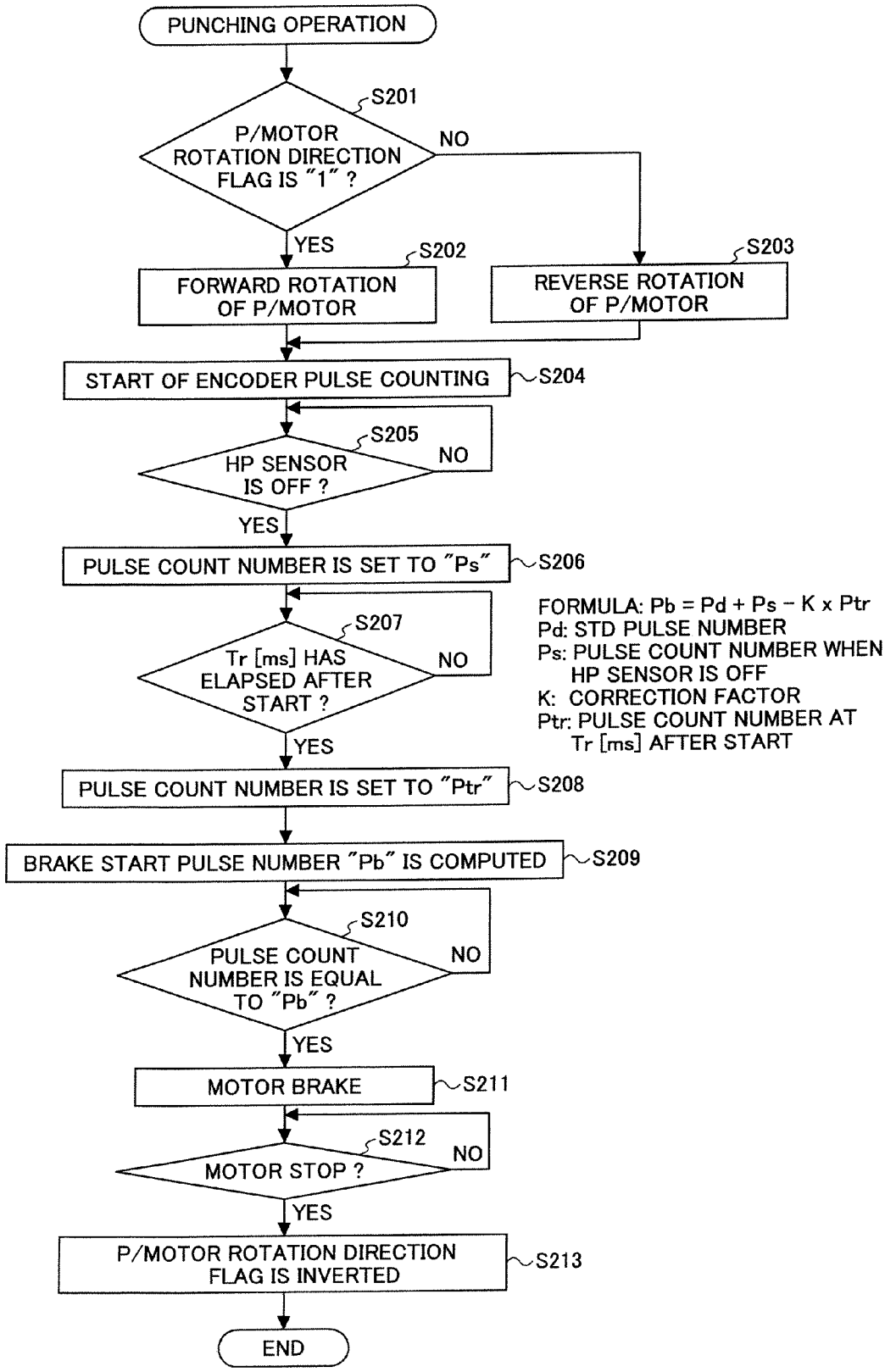
FIG. 32 is a flowchart for explaining the punching operation control procedure of a sixth preferred embodiment of the sheet punch device of the invention.

The control procedure at this time is shown in the flow chart of FIG. 32.

In the control procedure of FIG. 32, the rotation direction flag of the punch motor 3-6 is checked as being equal to 1 (step S201). If the rotation direction flag is equal to 1, the punch motor 3-6 is forwardly rotated (step S202).

If the rotation direction flag is not equal to 1, the punch motor 3-6 is reversely rotated (step S203).

Immediately after motor rotation, the time measurement or the pulse counting is started (step S204).

The home-position sensor 3-4 detects the cut-out edge of the home position, and it is detected whether the home-position sensor is turned off (step S205).

If the home-position sensor is turned off, the counted value of the pulse counter 361 is stored in the memory Ps (step S206).

Next, it is determined whether the elapsed time from the time of the motor rotation start of punching operation started at step S201 reached the standard time Tr (step S207).

The pulse-count value when elapsed time reaches at the standard time Tr is memorized in the memory Ptr in CPU 360 (step S208).

Based on the formula (5), the number Pb of brake start pulses is calculated as mentioned above (step S209).

Next, it is determined whether the pulse-count value reached Pb (step S210).

The motor brake is applied if the pulse-count value reaches Pb (step S211). Thereby, when the Ptr value is large, the brake starting position is made early, and when the Ptr value is small, the brake starting position can be made later.

It is determined whether the punch motor 3-6 stops by the operation of the motor brake (step S212).

If the punch motor 3-6 stops, the rotation direction flag 5 of the punch motor 3-6 will be reversed (step S213). Then, the control procedure of FIG. 32 is finished.

By using the DC brush motor and controlling it as in the control procedure of FIG. 32 as a punch motor (punching drive motor) 3-6, it becomes possible to improve motor stop precision, and small, the high speed, and low cost can be attained as a result.

Next, a description will be given of the seventh preferred embodiment.

The control procedure of the present embodiment is the same as that of the control procedure of the sixth preferred embodiment, and only the different point from the 6th preferred embodiment is explained.

Moreover, the same reference sign is given to each part equivalent to the 6th preferred embodiment, and the overlapping explanation is omitted.

By the initial setting, the stop position is corrected, and it constitutes from the present embodiment so that punching operation may be performed according to this corrected position.

In the present embodiment, if the home-position filler 3-7 rotates with rotation of DC brush motor 3-6 at the time of initial operation and punching operation, the home-position sensor 3-4 will detect the edge (home position OFF) of the home position cut and lacked.

The pulse count is simultaneously started by the pulse counter 361 in CPU 360. By this, the number of count pulses from the home position OFF (namely, position of the punch edge 3-1 or the vertical direction of 3-2) can be known after that at any time.

At the time of initial operation, when the number P of count pulses becomes the standard value Pbi, the brakes are applied to DC brush motor 3-6, and it stops the motor. The value Pdf which subtracted the number P of count pulses when the motor stops from the number of stop pulses of the target is memorized in the memory Psp in CPU 360 (RAM 362).

When it overruns to the stop position of the target, Psp serves as the value of minus, and when it stops to the front to the stop position of the target, Psp serves as the value of plus.

When motor speed becomes quick since the driver voltage is high (the maximum near in power supply specification tolerance), or since the drive load is light (variation between the machines) as the 6th preferred embodiment explained, the stop position becomes the tendency which overruns to the target. At this time, the Psp value becomes small (minus).

On the contrary, since the driver voltage is low (the minimum near in power supply specification tolerance), or since the drive load is heavy (mechanical variations), when motor speed becomes slow, the stop position becomes the tendency to come to the front to the target. At this time, the Psp value becomes large (plus).

Then, in order to bring close to the stop position of the target as much as possible, the brake starting position is corrected. When the Psp value is small, the brake starting position is made early.

On the contrary, when the Psp value is large, the brake starting position is made later. In this case, an example of the operation expression of the brake starting position which can be set is shown below.

In order to bring forward and carry out the brake starting position, and to make the brake starting position later when the Psp value is large when the Psp value is small, the pulse-count value Pb of the brake starting position is computed by using the following formula.

$$Pb=Pd+K\times Psp \tag{6}$$

where Pd is the standard number of pulses, K is the compensation coefficient, and Psp is the correction value.

Figure 33:
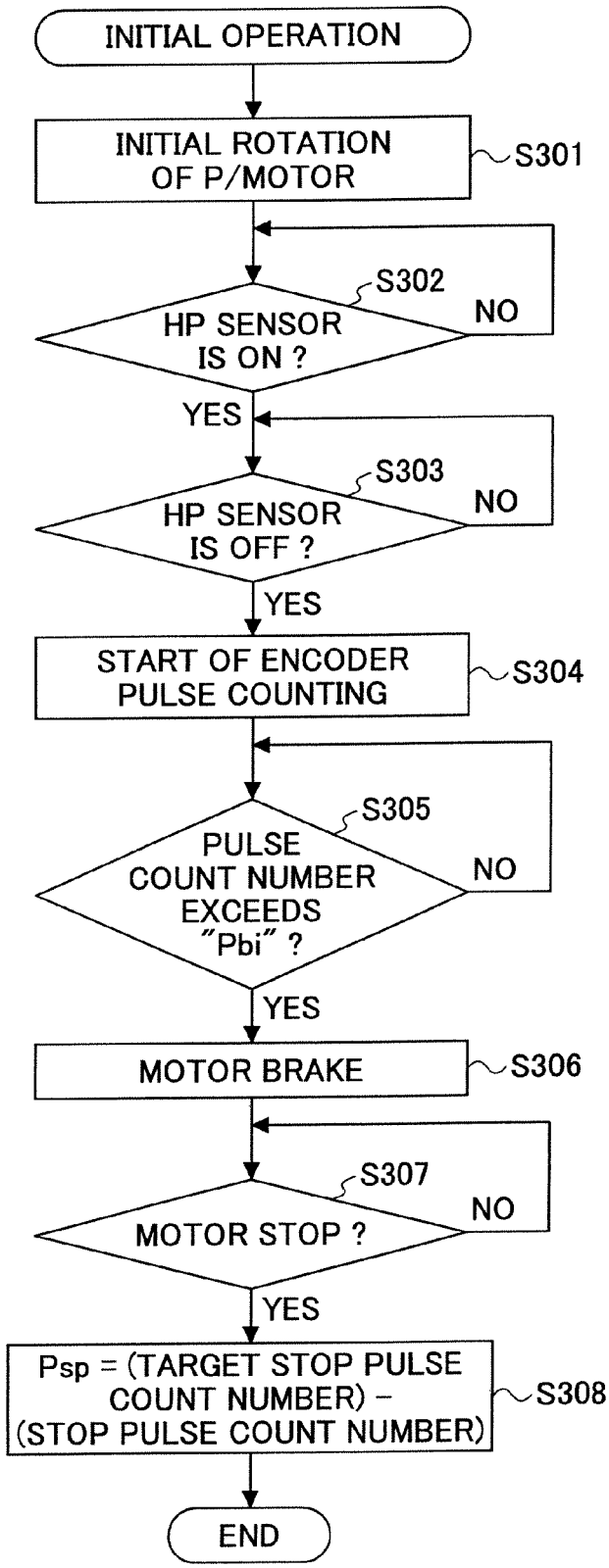
FIG. 33 is a flowchart for explaining the initial operation control procedure of a seventh preferred embodiment of the sheet punch device of the invention.

FIG. 33 is the flowchart for explaining the control procedure of initial operation at the time of performing the control.

In the control procedure of FIG. 33, the initial rotation of the punch motor 3-6 is performed (step S301).

It is determined whether the home-position sensor is turned on (step S302). If the home-position sensor is turned on, it is determined whether the home-position sensor is turned off (step S303).

If the home-position sensor is turned off and the home position is detected, the counting operation of the pulse from the encoder 3-5 is started (step S304).

Next, it is determined whether the pulse-count value exceeds the standard value Pbi (step S305).

If the pulse-count value exceeds the standard value Pbi, the brakes will be applied to the punch motor 3-6 (step S306).

Next, it is determined whether the punch motor 3-6 stops running (step S307).

When the punch motor 3-6 stops, the value which subtracted the number of count pulses at the time of the stop from the number of stop pulses of the target is saved in the memory Psp in CPU 360 (RAM 362) (step S308).

The Psp value is stored and the initial setting is completed.

Figure 34:
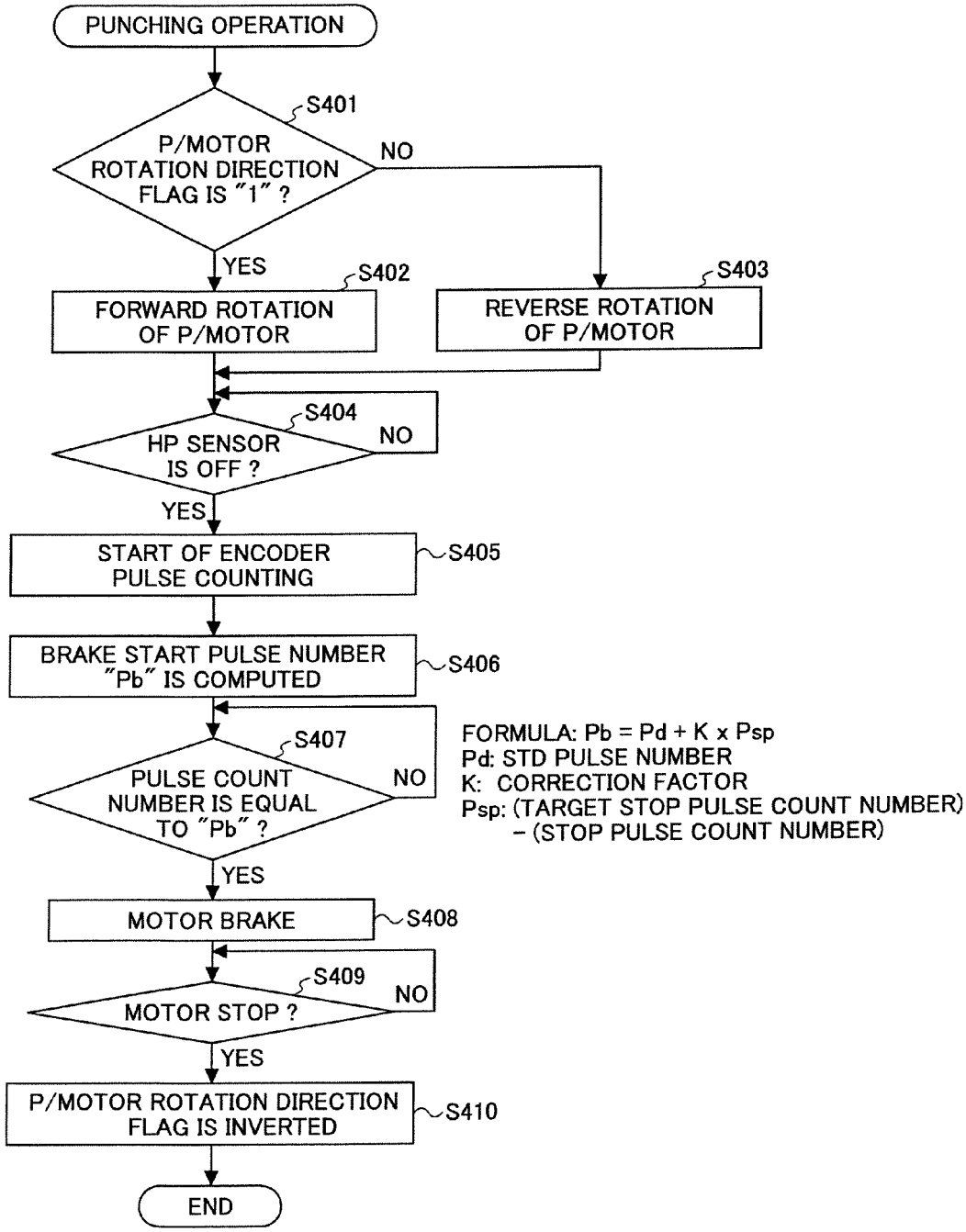
FIG. 34 is a flowchart for explaining the punching operation control procedure of the seventh preferred embodiment.

After the initial setting is done, the control procedure of punching operation of FIG. 34 is started.

In the control procedure of FIG. 34, the punch motor 3-6 rotation direction flag is checked as being equal to 1 (step S401).

The punch motor 3-6 is forwardly rotated if the rotation direction flag is equal to 1 (step S402). The punch motor 3-6 is reversely rotated if the rotation direction flag is not equal to 1 (step S403).

Next, it is determined whether the home-position sensor 3-4 is turned off (step S404). The detection of the home position starts the pulse counting of the encoder 3-5 (step S405).

Next, based on the above formula (6), the number Pb of brake start pulses is calculated (step S406).

It is determined whether the pulse-count value has reached the value of Pb (step S407).

If the pulse-count value reaches the value of Pb, the motor brake is applied to the punch motor 3-6 (step S408).

It is determined whether the punch motor 3-6 stops running (step S409).

If the punch motor 3-6 stops, the punch motor rotation direction flag is inverted (step S410). The control procedure is then finished.

According to the present embodiment, the correction at the time of the initial is performed even if the stop position of the motor changes, and the motor stop precision can be raised.

In addition, especially each part that is not explained is constituted on a par with the 6th preferred embodiment, and functions equally.

In addition to the driver voltage, the drive load, etc., the stop position may change also for the reasons of the sheet thickness, the temperature characteristic of the motor, etc.

In this case, it is inadequate to use only the correction value at the time of the initial.

Then, in order to bring close to the stop position of the target as much as possible always, the brake starting position is corrected at the time of punching operation including initial operation at each time.

In the eighth preferred embodiment, the value Pdf which subtracted the number P of count pulses when the motor stops not only at the time of the initial but at each time of the punching from the number of stop pulses of the target is computed. Pdf adds with last Psp and is again memorized in the memory Psp in CPU. This can always perform the compensation from the newest compensation information.

Since the control procedure of the eighth preferred embodiment is the same as that of the control procedure of the seventh preferred embodiment, only the different points from the seventh preferred embodiment will be described.

Moreover, the same reference numeral is given to each part equivalent to the sixth preferred embodiment, and duplicate description will be omitted.

Figure 35:
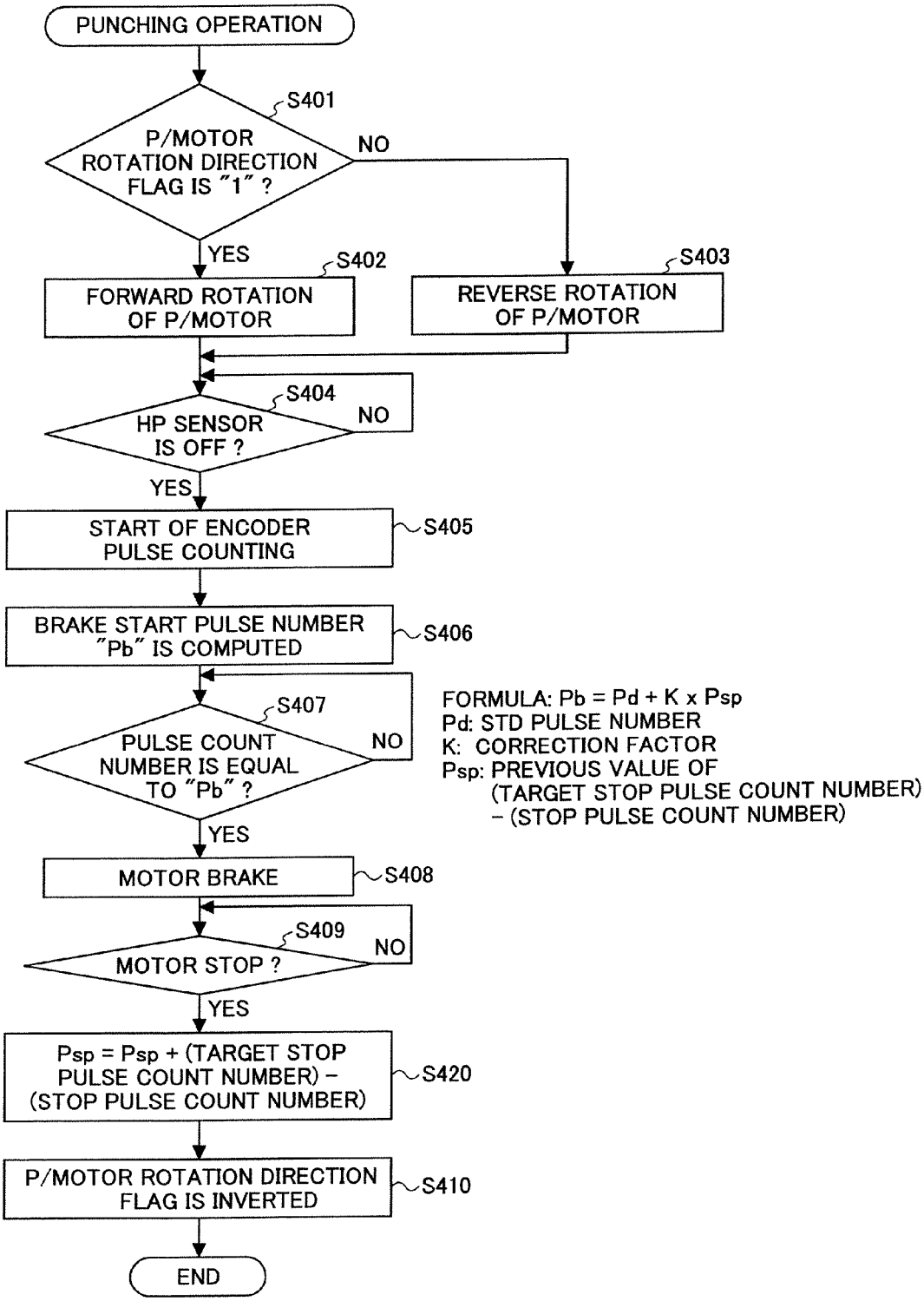
FIG. 35 is a flowchart for explaining the punching operation control procedure of an eighth preferred embodiment of the sheet punch device of the invention.

FIG. 35 is the flowchart for explaining the control procedure of the eighth preferred embodiment.

In the control procedure of FIG. 35, it is the feature to have put in processing of step S420 between step S409 of the 7th preferred embodiment and step S410. Namely, several count pulses when the motor stopped in step S409 and the motor stops in step S420 the value Pdf which subtracted P from the number of stop pulses of the target is added to the memory Psp in CPU 360 (RAM 362), and the added value is stored in the memory Psp.

That is, the calculation value of Psp+ (at the time of the number of stop pulses-stop of the target the number of count pulses) is memorized in the memory Psp in CPU 360 (RAM 362).

Finally, the processing which reverses the rotation direction flag of the punch motor 3-6 is performed (step S410), and the control procedure is ended.

In addition, especially each part that is not explained is constituted on a par with the first and 2nd preferred embodiments, and functions equally.

Since the brake starting position is corrected at the time of punching operation including initial operation at each time according to the eighth preferred embodiment, the motor stop precision can be further raised from the second preferred embodiment.

According to the eighth preferred embodiment, even when the motor stop position gets worse suddenly due to the noise or the like, in order to update the Psp, when next punching operation is not performed correctly.

In order to avoid this, the average in the number of times with the arbitrary stop position of punching operation is taken, and it constitutes from the 9th preferred embodiment so that motor stop operation of punching operation on and after next time may be changed.

It corrects on the basis of the value which computed the average of the 10 times of Pdf(s) before, specifically memorized the computed value to Psp, and is memorized by this Psp.

It is hard coming for this to receive influence in aggravation of the sudden stop precision.

Moreover, if the calculation of the average considers as the value except the maximum and the minimum value in 10 times, it will stop easily being able to receive influence in aggravation of the still more sudden stop precision.

Since the control procedure of the ninth preferred embodiment is the same as that of the control procedure of the eighth preferred embodiment, only the different point from the eighth preferred embodiment will be described.

Moreover, the same reference numeral is given to each part equivalent to the 6th preferred embodiment, and the overlapping explanation is omitted.

Figure 36:
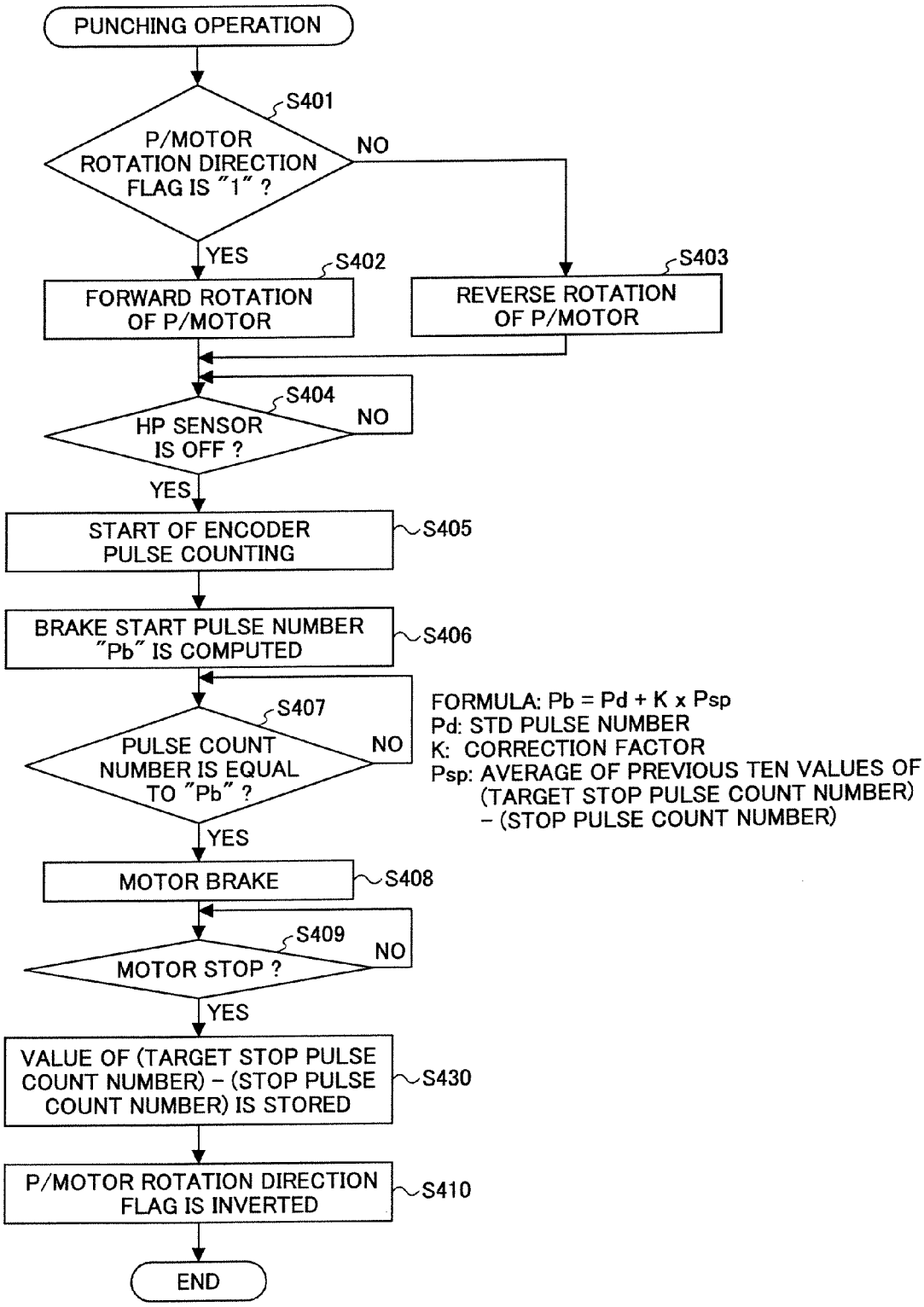
FIG. 36 is a flowchart for explaining the punching operation control procedure of a ninth preferred embodiment of the sheet punch device of the invention.

FIG. 36 is the flow chart for explaining the control procedure of the ninth preferred embodiment.

In the control procedure of FIG. 36, it is the feature to have changed step S406 of the 7th preferred embodiment into step S406*a*, and to have put in processing of step S430 between step S409 and step S410.

Namely, at step S406*a*, the above formula (6) is before calculated for correction value Psp by the average of number of count pulses) at the time of ten number of stop pulses-stop of (target. If the motor stops at step S409, number of count pulses) will be memorized at the time of the number of stop pulses-stop of (target (step S430).

Finally processing which reverses the punch motor rotation direction flag is performed (step S410), and the control procedure is ended.

In addition, the parts in the present embodiment which are essentially the same as corresponding parts in the first preferred embodiment are designated by the same reference numerals, and a description thereof will be omitted.

Since the average in the number of times with the arbitrary stop position of punching operation is taken and it is made to change motor stop operation of punching operation on and after next time according to the present embodiment, even when the stop position changes with the noises etc. suddenly, next punching operation can be performed exactly.

When the motor speed changes and the stop position varies also by the temperature characteristic of the motor, even if it performs the compensation, the subject still remains.

Although it is good when the time interval after the job is completed from initial operation to the first punching operation until the following job starts is short, when it passes for a long time, it is possible that motor temperature changes.

When the motor stop precision is influenced by the motor temperature, it becomes impossible to correct punching operation of the first sheet after prolonged progress good.

In order to avoid the problem, just before receiving the first sheet of the arbitrary jobs, punching operation is performed in the state where there is no sheet, and motor stop operation of punching operation of the first sheet is changed with the stop position. This can always perform the compensation from the compensation information on this temperature.

With the arbitrary job, the job in the case of having passed more than the time T since the end of the front job is sufficient, and you may carry out for every continuous job.

Figure 37:
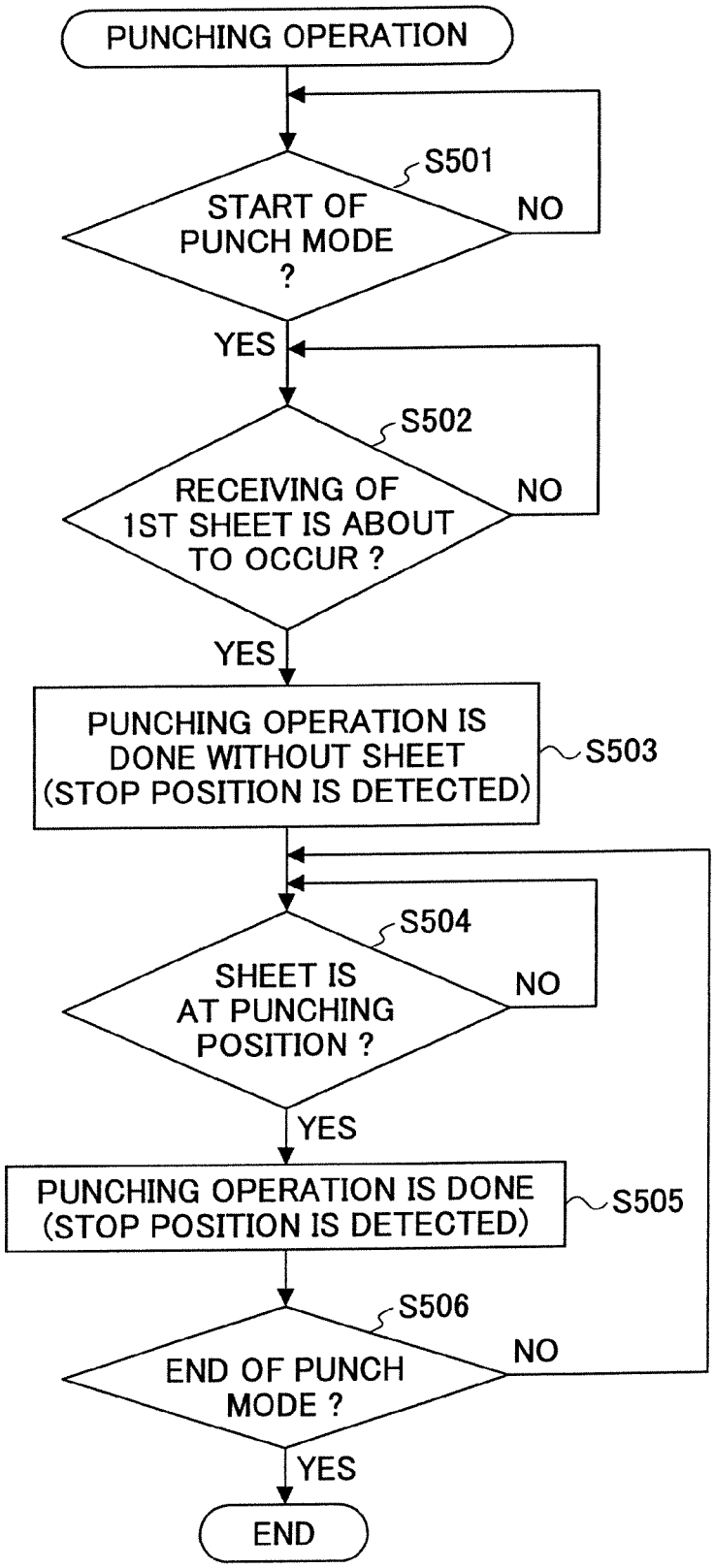
FIG. 37 is a flowchart for explaining the punching operation control procedure of a tenth preferred embodiment of the sheet punch device of the invention.

FIG. 37 is the flowchart for explaining the control procedure of the tenth preferred embodiment.

In the control procedure of FIG. 37, it is determined whether the punch mode is started (step S501).

If the punch mode is started, it is determined whether it is just before receiving the first sheet (step S502).

If it is just before the receiving of the first sheet, the punching operation will be performed without the sheet and the stop position is measured (step S503).

Next, it is determined whether the sheet has reached the punching position (step S504).

If the sheet has reached the punching position, the punching operation is performed by the punch unit 3 (step S505). In that case, the compensation of the punch position is performed and the stop position is measured.

It is determined whether the punch mode is completed (step S506). It performs until it repeats operation after step S504 and the punch mode ends these operation, if the punch mode is not completed.

According to the present embodiment, just before receiving the first sheet in the arbitrary job, the punching operation is performed without sheet, and the motor stop operation in the punching operation of the first sheet is changed with the stop position. It is possible to always perform the compensation from the compensation information on this temperature, and it is not influenced by temperature change by this the hole dawn precision is securable. As mentioned above, when according to the present invention it is small, the sheet punch device which can be processed high-speed, the sheet processing device equipped with this sheet punch device, and the image forming system equipped with this sheet processing device can be offered at low cost and DC brush motor is especially used as a drive motor for punching operation, motor stop precision can be constituted good.

The present invention is not limited to the above-described embodiments, and variations and modifications may be made without departing from the scope of the present invention.

Further, the present application is based on Japanese priority application No. 2003-146877, filed on May 23, 2003, and Japanese priority application No. 2003-307585, filed on Aug. 29, 2003, the entire contents of which are hereby incorporated by reference.

What is claimed is:

1. A sheet punch device for punching a sheet delivered from an external device, comprising:

a motor performing a punching operation on the sheet;

a motor-drive amount detection unit configured to detect an amount of driving of the motor;

a timer unit configured to detect that a predetermined standard time has elapsed during the driving of the motor; and a control unit configured to cause the motor drive amount detection unit to detect a motor-drive amount of the motor during the punching operation at a time the standard time has elapsed, the control unit being further configured to change a starting position of a motor stop operation in accordance with the detected motor-drive amount.

2. The sheet punch device according to claim 1, wherein the timer unit is configured to detect that the predetermined standard time has elapsed after a start of the motor driving.

3. The sheet punching device according to claim 1, wherein the motor-drive amount detecting unit is configured to detect an amount of driving of the motor when the punch is in a position other than a home position.

4. The sheet punching device according to claim 1, wherein the motor-drive amount detecting unit is configured to detect an amount of driving of the motor based on a number of pulses produced by rotation of the motor.

5. A sheet punch device for punching a sheet delivered from an external device, comprising:

motor means for performing a punching operation on the sheet;

motor-drive amount detection means for detecting an amount of driving of the motor means;

timer means for detecting that a predetermined standard time has elapsed during the driving of the motor means; and control means for causing the motor drive amount detection means to detect a motor-drive amount of the motor means during the punching operation at a time the standard time has elapsed, and the control means changing a starting position of a motor stop operation in accordance with the detected motor-drive amount.

* * * * *